US007118359B2

(12) United States Patent
Hosono

(10) Patent No.: US 7,118,359 B2
(45) Date of Patent: Oct. 10, 2006

(54) OIL PUMP ROTOR

(75) Inventor: Katsuaki Hosono, Niigata (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/622,107

(22) Filed: Jul. 16, 2003

(65) Prior Publication Data

US 2004/0067151 A1 Apr. 8, 2004

(30) Foreign Application Priority Data

Jul. 18, 2002 (JP) ..... P2002-209836
Jul. 18, 2002 (JP) ..... P2002-209837
Jul. 18, 2002 (JP) ..... P2002-209838
Jul. 18, 2002 (JP) ..... P2002-209839

(51) Int. Cl.
*F03C 2/00* (2006.01)

(52) U.S. Cl. ..... 418/150; 418/171

(58) Field of Classification Search ..... 418/150, 418/171, 166

See application file for complete search history.

(56) References Cited

U.S. PATENT DOCUMENTS 3,982,445 A * 9/1976 Rouverol ..... 74/462
4,657,492 A * 4/1987 Saegusa ..... 418/150
5,163,826 A * 11/1992 Cozens ..... 418/170
5,226,798 A 7/1993 Eisenmann
5,628,626 A * 5/1997 Hansen ..... 418/150
5,772,419 A * 6/1998 Hansen et al. ..... 418/150
5,876,193 A * 3/1999 Hosono et al. ..... 418/150
6,077,059 A 6/2000 Hosono
5,368,455 A1 11/2004 Eisenmann

FOREIGN PATENT DOCUMENTS

DE 330 610 C 12/1920
EP 0 457 491 A1 11/1991
FR 2 492 474 A 4/1982
GB 233 423 A 5/1925
JP 05-256268 A1 10/1993

OTHER PUBLICATIONS

English translation of JP05-256268 published on Oct. 5, 1993.
English Translation of DE 330 610 C published on Dec. 18, 1920.

* cited by examiner

*Primary Examiner*—Theresa Trieu
(74) *Attorney, Agent, or Firm*—Darby & Darby

(57) ABSTRACT

An oil pump rotor assembly for an oil pump which enables reduction of noise while preventing pump performance and mechanical efficiency from being degraded. In this oil pump rotor assembly, the tooth tip profile of each of at least one of external teeth of an inner rotor and internal teeth of an outer rotor the inner rotor is formed such that a base cycloid curve is divided at a midpoint thereof to obtain two tooth curve segments, and the two tooth curve segments are separated by a predetermined distance along the circumference of a base circle or in the direction of a tangent of the base cycloid curve drawn at the midpoint thereof and are smoothly connected to each other using a curve or a straight line.

27 Claims, 12 Drawing Sheets

OIL PUMP ROTOR

BACKGROUND OF THE INVENTION

1. Field of the Invention

This invention relates to an oil pump rotor assembly used in an oil pump which draws and discharges fluid by volume change of cells formed between an inner rotor and an outer rotor.

2. Background Art

Conventionally, internal gear pumps, which are generally compact and simply constructed, are widely used as pumps for lubrication oil in automobiles and as oil pumps for automatic transmissions, etc. Such an oil pump comprises an inner rotor having "n" external teeth (hereinafter "n" indicates a natural number), an outer rotor having "n+1" internal teeth which are engageable with the external teeth, and a casing in which a suction port for drawing fluid and a discharge port for discharging fluid are formed, and fluid is drawn and is discharged by rotation of the inner rotor which produces changes in the volumes of cells formed between the inner rotor and the outer rotor.

With regard to such internal gear pumps, in order to reduce pump noise and to increase mechanical efficiency, various technical means have been employed such as providing a tip clearance having appropriate size between the tooth tips of the inner and outer rotors, modifying tooth profiles which are formed using, for example, cycloid curves, etc. More specifically, in some oil pumps, the profiles of the teeth of the outer rotor are uniformly cut so as to ensure clearance between the surfaces of the teeth of the inner and outer rotors, or alternatively, the cycloid curve defining the shape of the teeth are partially flattened so as to modify the tooth profiles (see, for example, Japanese Unexamined Patent Application, First Publication No. Hei 05-256268).

However, when conventional countermeasures are employed such as providing a tip clearance by uniformly cutting the profiles of the teeth, or flattening the cycloid curve by adjusting the diameter of a rolling circle that generates the cycloid curve or by forming a portion of the tooth profile using a straight line, even though a sufficient tip clearance is ensured, clearance between the tooth surfaces is also increased, which leads to problems such as increase in transmission torque loss due to play between the rotors or due to slip between the tooth surfaces, pump noise due to impacts between the rotors, etc.

Moreover, when inappropriate clearance is provided between the tooth surfaces due to adjustment of tooth surface profiles, hydraulic pulsation may be produced or increased, which may lead to problems such as degradation of pumping performance or mechanical efficiency, pump noise, etc.

SUMMARY OF THE INVENTION

Based on the above problems, an object of the present invention is to reduce noise emitted from an oil pump while preventing pumping performance and mechanical efficiency thereof from being degraded by properly forming the profiles of teeth of an inner rotor and an outer rotor of the oil pump.

In order to achieve the above object, in an oil pump rotor assembly of the present invention, the width of a tooth tip is increased by separating a cycloid curve, which defines the tooth tip, at a midpoint thereof by a predetermined distance, thereby gap (or clearance) between the tooth surfaces, which is defined in the direction of tooth width when the rotors engage each other, is decreased.

More specifically, in an oil pump rotor assembly according to a first aspect of the present invention, the tooth tip profile of an inner rotor is formed such that an epicycloid curve, which is generated by rolling a circumscribed-rolling circle Ai along a base circle Di without slip, is equally divided into two at a midpoint thereof to obtain two outer tooth curve segments, and the two outer tooth curve segments are separated by a predetermined distance and are smoothly connected to each other using a curve or a straight line.

In this oil pump rotor assembly, each of the tooth profiles of an outer rotor is formed such that the tooth space profile thereof is formed using an epicycloid curve which is generated by rolling a circumscribed-rolling circle Ao along a base circle Do without slip, and the tooth tip profile thereof is formed using a hypocycloid curve which is generated by rolling an inscribed-rolling circle Bo along the base circle Do without slip.

The tooth space profile of the inner rotor is formed based on a hypocycloid curve which is formed by rolling an inscribed-rolling circle Bi along the base circle Di without slip.

The separation of the two outer tooth curve segments may be performed in such a manner that the two outer tooth curve segments are moved along the circumference of the base circle Di.

The separation of the two outer tooth curve segments may be performed in such a manner that the two outer tooth curve segments are moved in the direction of a tangent of the epicycloid curve drawn at the midpoint thereof.

The separation of the two outer tooth curve segments may be performed in such a manner that the two outer tooth curve segments are first moved along the circumference of the base circle Di, and then moved in the direction of a tangent of the epicycloid curve drawn at the midpoint thereof.

The separation of the two outer tooth curve segments may be performed in such a manner that the two outer tooth curve segments are first moved in the direction of a tangent of the epicycloid curve drawn at the midpoint thereof, and then moved along the circumference of the base circle Di.

Moreover, in this oil pump rotor assembly, the inner rotor and the outer rotor are preferably formed such that the following inequalities are satisfied:

$$t/4 \leqq \alpha \leqq 3t/4,$$

where, "t" is the magnitude of a tip clearance (i.e., the total distance of gaps formed between the tooth surfaces of the inner and outer rotors along the line passing through the centers of the inner and outer rotors in a rotational phase in which the tooth tip apex of the outer tooth of the inner rotor and the tooth tip apex of the inner tooth of the outer rotor oppose each other), and "α" is the predetermined distance between the two outer tooth curve segments.

In this oil pump rotor assembly, it is more preferable to set the predetermined distance "α" between the two outer tooth curve segments so as to satisfy the following inequalities:

$$2t/5 \leqq \alpha \leqq 3t/5.$$

In an oil pump rotor assembly according to a second aspect of the present invention, the tooth tip profile of an outer rotor is formed such that a hypocycloid curve, which is generated by rolling an inscribed-rolling circle Bo along a base circle Do without slip, is equally divided into two at a midpoint thereof to obtain two inner tooth curve segments, and the two inner tooth curve segments are separated by a predetermined distance and are smoothly connected to each other using a curve or a straight line.

In this oil pump rotor assembly, the tooth space profile of the outer rotor is formed based on a hypocycloid curve which is formed by rolling a circumscribed-rolling circle Ao along the base circle Do without slip.

Each of the tooth profiles of an inner rotor is formed such that the tooth tip profile thereof is formed using an epicycloid curve which is generated by rolling a circumscribed-rolling circle Ai along a base circle Di without slip, and the tooth space profile thereof is formed using a hypocycloid curve which is generated by rolling an inscribed-rolling circle Bi along the base circle Di without slip.

The separation of the two inner tooth curve segments may be performed in such a manner that the two inner tooth curve segments are moved along the circumference of the base circle Do.

The separation of the two inner tooth curve segments may be performed in such a manner that the two inner tooth curve segments are moved in the direction of a tangent of the hypocycloid curve drawn at the midpoint thereof.

The separation of the two inner tooth curve segments may be performed in such a manner that the two inner tooth curve segments are first moved along the circumference of the base circle Do, and then moved in the direction of a tangent of the hypocycloid curve drawn at the midpoint thereof.

The separation of the two inner tooth curve segments may be performed in such a manner that the two inner tooth curve segments are first moved in the direction of a tangent of the hypocycloid curve drawn at the midpoint thereof, and then moved along the circumference of the base circle Do.

Moreover, in this oil pump rotor assembly, the inner rotor and the outer rotor are preferably formed such that the following inequalities are satisfied:

$$t/4 \leqq \beta \leqq 3t/4,$$

where, "t" is the magnitude of a tip clearance, and "β" is the predetermined distance between the two inner tooth curve segments.

In this oil pump rotor assembly, it is more preferable to set the predetermined distance "β" between the two inner tooth curve segments so as to satisfy the following inequalities:

$$2t/5 \leqq \beta \leqq 3t/5.$$

In an oil pump rotor assembly according to a third aspect of the present invention, the tooth tip profile of an inner rotor is formed such that an epicycloid curve, which is generated by rolling a circumscribed-rolling circle Ai along a base circle Di without slip, is equally divided into two at a midpoint thereof to obtain two outer tooth curve segments, and the two outer tooth curve segments are separated by a predetermined distance and are smoothly connected to each other using a curve or a straight line, and the tooth tip profile of an outer rotor is formed such that a hypocycloid curve, which is generated by rolling an inscribed-rolling circle Bo along a base circle Do without slip, is equally divided into two at a midpoint thereof to obtain two inner tooth curve segments, and the two inner tooth curve segments are separated by a predetermined distance and are smoothly connected to each other using a curve or a straight line.

In this oil pump rotor assembly, the tooth space profile of the inner rotor is formed based on a hypocycloid curve which is formed by rolling an inscribed-rolling circle Bi along the base circle Di without slip.

The tooth space profile of the outer rotor is formed based on an epicycloid curve which is formed by rolling a circumscribed-rolling circle Ao along the base circle Do without slip.

The separation of the two outer tooth curve segments may be performed in such a manner that the two outer tooth curve segments are moved along the circumference of the base circle Di, and the separation of the two inner tooth curve segments may be performed in such a manner that the two inner tooth curve segments are moved along the circumference of the base circle Do.

The separation of the two outer tooth curve segments may be performed in such a manner that the two outer tooth curve segments are moved in the direction of a tangent of the epicycloid curve drawn at the midpoint thereof, the separation of the two inner tooth curve segments may be performed in such a manner that the two inner tooth curve segments are moved in the direction of a tangent of the hypocycloid curve drawn at the midpoint thereof.

The separation of the two outer tooth curve segments may be performed in such a manner that the two outer tooth curve segments are first moved along the circumference of the base circle Di, and then moved in the direction of a tangent of the epicycloid curve drawn at the midpoint thereof, and the separation of the two inner tooth curve segments may be performed in such a manner that the two inner tooth curve segments are first moved along the circumference of the base circle Do, and then moved in the direction of a tangent of the hypocycloid curve drawn at the midpoint thereof.

The separation of the two outer tooth curve segments may be performed in such a manner that the two outer tooth curve segments are first moved in the direction of a tangent of the epicycloid curve drawn at the midpoint thereof, and then moved along the circumference of the base circle Di, and the separation of the two inner tooth curve segments may be performed in such a manner that the two inner tooth curve segments are first moved in the direction of a tangent of the hypocycloid curve drawn at the midpoint thereof, and then moved along the circumference of the base circle Do.

Moreover, in this oil pump rotor assembly, the inner rotor and the outer rotor are preferably formed such that the following inequalities are satisfied:

$$t/4 \leqq \alpha \leqq 3t/4; \text{ and}$$

$$t/4 \leqq \beta \leqq 3t/4,$$

where "t" is a tip clearance, "α" is the predetermined distance between the two outer tooth curve segments, and "β" is the predetermined distance between the two inner tooth curve segments.

In this oil pump rotor assembly, it is more preferable to set the predetermined distance "α" between the two outer tooth curve segments and the predetermined distance "β" between the two inner tooth curve segments so as to satisfy the following inequalities:

$$2t/5 \leqq \alpha \leqq 3t/5; \text{ and}$$

$$2t/5 \leqq \beta \leqq 3t/5.$$

In the oil pump rotor assemblies according to the first to third aspects of the present invention, the inner rotor and the outer rotor may be preferably formed such that the following equations are satisfied in order to ensure an appropriate clearance between the tooth surfaces of the inner and outer rotors:

$$øAi+t/2=øAo;$$

$$øBi-t/2=øBo;$$

$$øAi+øBi=øAo+øBo=2e;$$

$$øDi=n\cdot(øAi+øBi);$$

$$øDo=(n+1)\cdot(øAo+øBo);\text{ and}$$

$$(n+1)\cdot øDi=n\cdot øDo,$$

where "n" ("n" is a natural number) is the number of outer teeth of the inner rotor, (n+1) is the number of inner teeth of the outer rotor, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, and "e" is an eccentric distance between the inner rotor and the outer rotor.

The inner rotor and the outer rotor may also be preferably formed such that the following equations are satisfied in order to ensure an appropriate clearance between the tooth surfaces of the inner and outer rotors:

$$øAi+t/(n+2)=øAo;$$

$$øBi=øBo;$$

$$øAi+øBi=2e;$$

$$øDi=n\cdot(øAi+øBi);\text{ and}$$

$$øDo=øDi\cdot(n+1)/n+t\cdot(n+1)/(n+2).$$

The inner rotor and the outer rotor may also be preferably formed such that the following equations are satisfied in order to ensure an appropriate clearance between the tooth surfaces of the inner and outer rotors:

$$øAi=øAo;$$

$$øBi+t/(n+2)=øBo;$$

$$øAi+øBi=2e;$$

$$øDi=n\cdot(øAi+øBi);\text{ and}$$

$$øDo=øDi\cdot(n+1)/n+t\cdot(n+1)/(n+2).$$

According to the present invention, at least one of the tooth profile of the inner rotor and the tooth profile of the outer rotor is formed such that the circumferential thickness of the tooth tip is slightly greater than that of a conventional one by equally dividing a cycloid curve for defining the tooth profile into two at a midpoint thereof to obtain two tooth curve segments, and by moving the two tooth curve segments along the circumference of the base circle or by moving in the direction of a tangent of the cycloid curve drawn at the midpoint thereof, therefore, an oil pump rotor assembly, in which not only the tip clearance but also clearance between the tooth surfaces are appropriately ensured, can be obtained.

That is, by increasing the size of the tooth tip in the direction of the circumference of the base circle or in the direction of the tangent of the cycloid curve drawn at the midpoint thereof based on an oil pump rotor assembly in which an appropriate tip clearance is ensured, the circumferential thickness of the tooth tip is made to be greater than that of a conventional one without changing the position of the tooth tip apex; therefore, an oil pump rotor assembly, which emits less noise, and which exhibits better mechanical performance when compared with a conventional one, can be obtained.

DETAILED DESCRIPTION OF THE PREFERRED EMBODIMENTS

First Embodiment

A first embodiment of an oil pump rotor assembly according to the present invention will be explained below with reference to FIGS. 1 to 3C.

Figure 1:
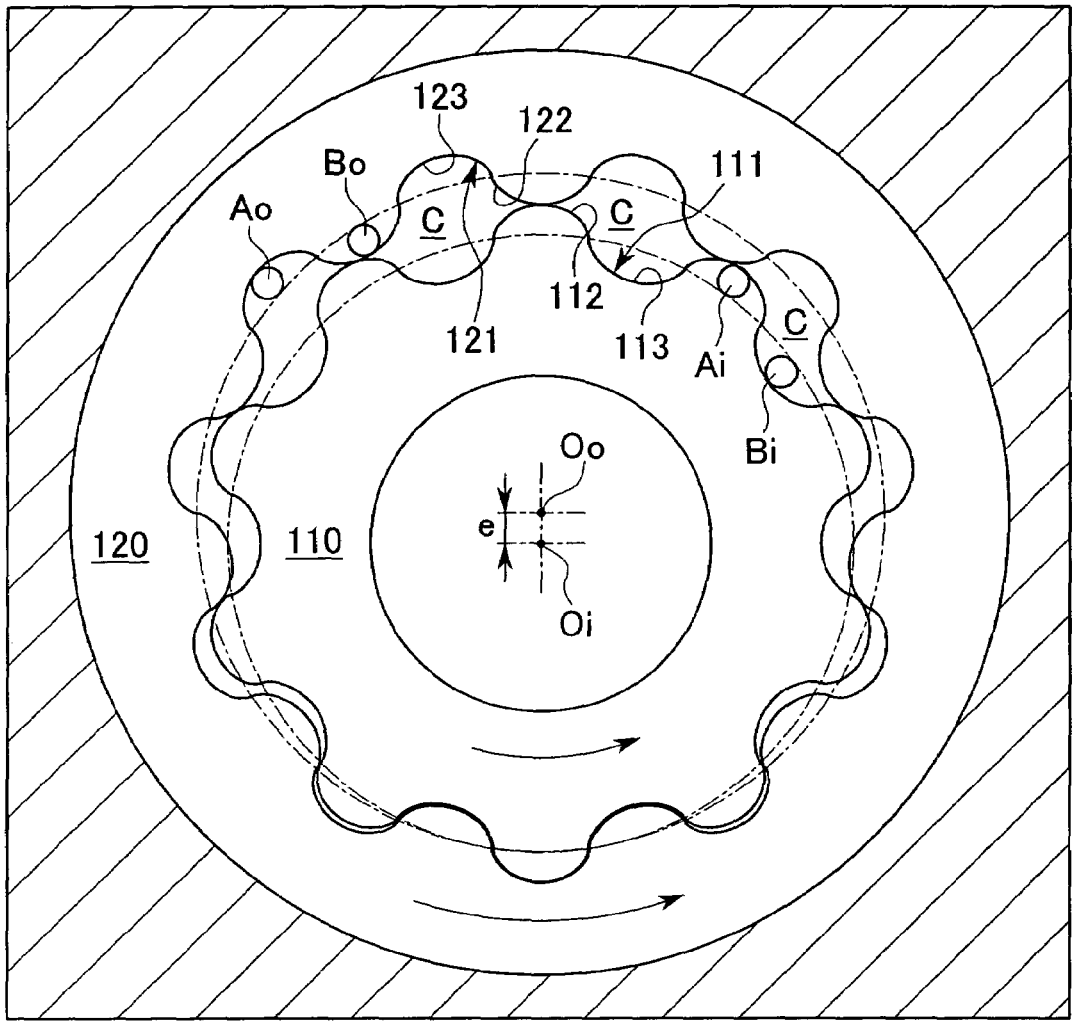
FIG. 1 is a diagram showing a first embodiment of an oil pump rotor assembly according to the present invention.

The oil pump shown in FIG. 1 comprises an inner rotor 110 provided with "n" external teeth 111 ("n" indicates a natural number, and n=10 in this embodiment), an outer rotor 120 provided with "n+1" internal teeth 121 (n+1=11 in this embodiment) which are engageable with the external teeth 111, and a casing 30 which accommodates the inner rotor 110 and the outer rotor 120.

Between the tooth surfaces of the inner rotor 110 and outer rotor 120, there are formed plural cells C in the direction of rotation of the inner rotor 110 and outer rotor 120. Each of the cells C is delimited at a front portion and at a rear portion as viewed in the direction of rotation of the inner rotor 110 and outer rotor 120 by contact regions between the external teeth 111 of the inner rotor 110 and the internal teeth 121 of the outer rotor 120, and is also delimited at either side portions by the casing 30, so that an independent fluid conveying chamber is formed. Each of the cells C moves while the inner rotor 110 and outer rotor 120 rotate, and the volume of each of the cells C cyclically increases and decreases so as to complete one cycle in a rotation.

In the casing 30, there are formed a suction port, which communicates with one of the cells C whose volume increases gradually, and a discharge port, which communicates with one of the cells C whose volume decreases gradually, and fluid drawn into one of the cells C through the suction port is transported as the rotors 110 and 120 rotate, and is discharged through the discharge port.

A clearance that is formed between the apex of the tooth tip 112 of the inner rotor 110 and the apex of the tooth tip 122 of the outer rotor 120, which face each other on a line passing through the centers Oi and Oo of the rotors, is designated by a tip clearance. The size "$t_1$" of this tip clearance is defined as the size of a tip clearance that is formed in a state in which the rotors 110 and 120 are disposed such that clearance between the tooth tip 112 of the inner rotor 110 and the tooth space 123 of the outer rotor 120, which engage each other on the line passing through the centers Oi and Oo at a diametrically opposing position, is zero.

When the rotors are driven, the center Oi of the inner rotor 110 and the center Oo of the outer rotor 120 are disposed to have an eccentric distance therebetween so that the same clearance $t_1/2$ is formed between the tooth surfaces at two positions, located on the line passing through the centers Oi and Oo, at which the tooth surfaces face each other. The eccentric distance between the centers Oi and Oo is designated by "e".

The inner rotor 110 is mounted on a rotational axis so as to be rotatable about the center Oi, and the tooth profile of each of the external teeth 111 of the inner rotor 110 is formed using an epicycloid curve 116, which is generated by rolling a circumscribed-rolling circle Ai (whose diameter is øAi) along the base circle Di (whose diameter is øDi) of the inner rotor 110 without slip, and using a hypocycloid curve 117, which is generated by rolling an inscribed-rolling circle Bi (whose diameter is øBi) along the base circle Di without slip.

The outer rotor 120 is mounted so as to be rotatable about the center Oo, and the center thereof is positioned so as to have an offset (the eccentric distance is "e") from the center Oi. The tooth profile of each of the internal teeth 121 of the outer rotor 120 is formed using an epicycloid curve 127, which is generated by rolling a circumscribed-rolling circle Ao (whose diameter is øAo) along the base circle Do (whose diameter is øDo) of the outer rotor 120 without slip, and using a hypocycloid curve 126, which is generated by rolling an inscribed-rolling circle Bo (whose diameter is øBo) along the base circle Do without slip.

The equations which will be discussed below are to be satisfied between the inner rotor 110 and the outer rotor 120. Note that dimensions will be expressed in millimeters.

With regard to the base curves that define tooth profiles of the inner rotor 110, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi \cdot øDi = n \cdot \pi \cdot (øAi + øBi), \text{ i.e.,}$$

$$øDi = n \cdot (øAi + øBi) \quad \text{(I).}$$

Similarly, with regard to the base curves that define tooth profiles of the outer rotor 120, because the length of circumference of the base circle Do of the outer rotor 120 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi øDo = (n+1) \cdot \pi \cdot (øAo + øBo), \text{ i.e.,}$$

$$øDo = (n+1) \cdot (øAo + øBo) \quad \text{(II).}$$

Next, since the inner rotor 110 engages the outer rotor 120, $$øAi + øBi = øAo + øBo = 2e \quad \text{(III).}$$

Based on the above equations (I), (II), and (III), $$(n+1) \cdot øDi = n \cdot øDo \quad \text{(IV).}$$

Moreover, with regard to the tip clearance which is formed between the apex of the tooth tip 112 of the external tooth 111 and the apex of the tooth tip 122 of the internal tooth 121 in a rotational phase advancing by 180° from a rotational phase in which the apexes face each other, the following equations are satisfied:

$$øAi + t_1/2 = øAo \quad \text{(V); and}$$

$$øBi - t_1/2 = øBo \quad \text{(VI).}$$

The detailed profile of each of the external teeth 111 of the inner rotor 110 will be explained with reference to FIGS. 2A to 2C. The external teeth 111 of the inner rotor 110 are formed by alternately arranging tooth tips 112 and tooth spaces 113 in the circumferential direction.

In order to form the profile of the tooth tip 112, first, the epicycloid curve 116 (FIG. 2A) generated by the circumscribed-rolling circle Ai is equally divided at a midpoint $A_1$ thereof into two segments that are designated by outer tooth curve segments 112*a* and 112*b*, respectively. Here, the midpoint $A_1$ of the epicycloid curve 116 is a point that symmetrically divides the epicycloid curve 116 into two which is generated by a specific point on the circumscribed-rolling circle Ai by rolling the circumscribed-rolling circle Ai by one turn on the base circle Di of the inner rotor 110 without slip. In other words, the midpoint $A_1$ is a point that is reached by the specific point when the circumscribed-rolling circle Ai rolls a half turn.

Figure 2A:
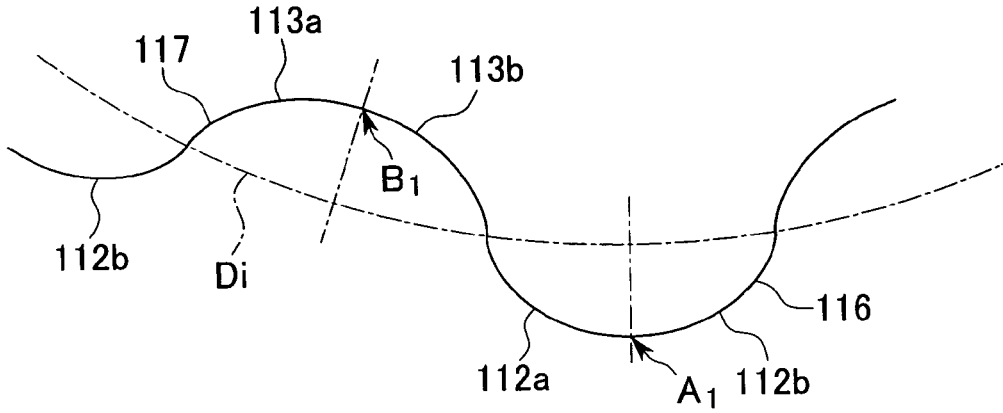
FIGS. 2A to 2C are enlarged views showing the tooth profiles of an inner rotor of the oil pump rotor assembly shown in FIG. 1.
Figure 2B:
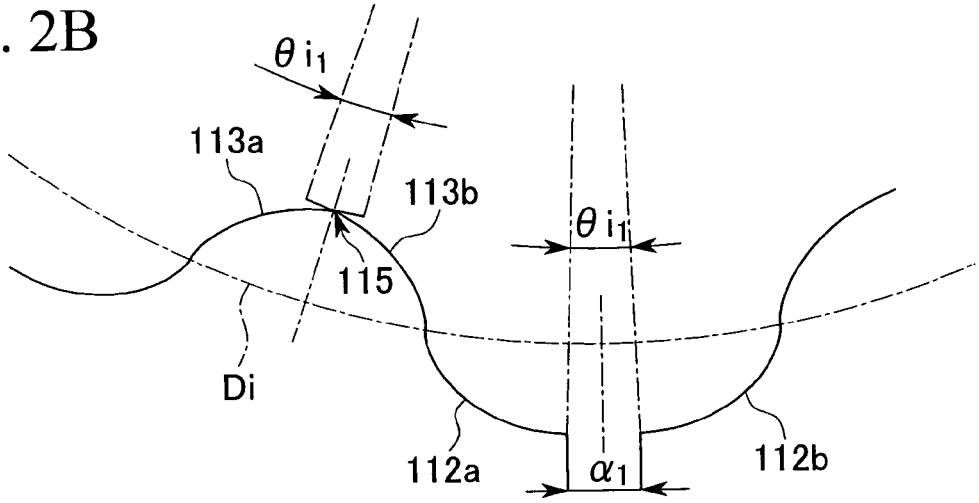

Next, as shown in FIG. 2B, the outer tooth curve segments 112*a* and 112*b* are moved about the center Oi and along the circumference of the base circle Di so that a distance "$\alpha_1$" is ensured between the outer tooth curve segments 112*a* and 112*b*. Here, an angle defined by two lines, which are drawn by connecting the center Oi of the base circle Di and the ends of the outer tooth curve segments 112*a* and 112*b*, is designated by $\theta i_1$.

Figure 2C:
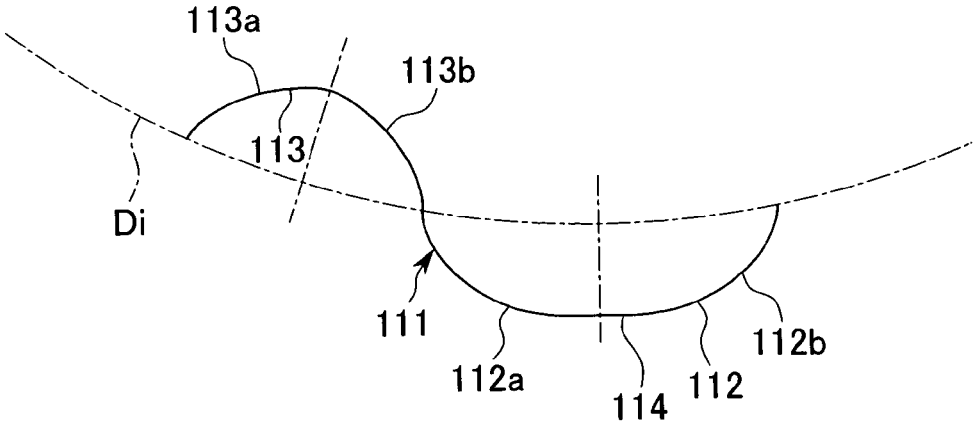

As shown in FIG. 2C, the separated ends of the outer tooth curve segments 112*a* and 112*b* are connected to each other by a complementary line 114 consisting of a straight line, and the obtained continuous curve is used as the profile of the tooth tip 112.

That is, the tooth tip 112 is formed using a continuous curve that includes the outer tooth curve segments 112*a* and 112*b*, which are separated from each other, and the complementary line 114 connecting the outer tooth curve segment 12*a* with the outer tooth curve segment 112*b*.

As a result, the circumferential thickness of the tooth tip 112 is greater than a tooth tip which is formed just using the simple epicycloid curve 116 by an amount corresponding to the angle $\theta i_1$ defined by two lines, which are drawn by connecting the center Oi of the base circle Di and the ends of the complementary line 114. In this embodiment, the complementary line 114, which connects the outer tooth curve segment 112*a* with the outer tooth curve segment 112*b*, is a straight line; however, the complementary line 114 may be a curve.

The circumferential thickness of the tooth tip 112 is made to be greater than that of a conventional tooth tip as explained above, and on the other hand, in this embodiment, the width of the tooth space 113 is decreased, and tooth profiles are smoothly connected to each other over the entirety of the circumference.

More specifically, in order to form the profile of the tooth space 113, first, the hypocycloid curve 117 (FIG. 2A) generated by the inscribed-rolling circle Bi is equally divided at a midpoint $B_1$ thereof into two segments that are designated by curve segments 113*a* and 113*b*, respectively. Here, the midpoint $B_1$ of the hypocycloid curve 117 is a point that symmetrically divides the hypocycloid curve 117 into two which is generated by a specific point on the inscribed-rolling circle Bi by rolling the inscribed-rolling circle Bi by one turn on the base circle Di of the inner rotor 110 without slip. In other words, the midpoint $B_1$ is a point that is reached by the specific point when the inscribed-rolling circle Bi rolls a half turn.

Next, as shown in FIG. 2B, the curve segments 113*a* and 113*b* are moved along the circumference of the base circle Di so that the ends of the curve segments 113*a* and 113*b* are respectively connected to the ends of the continuous curve that forms the tooth tip 112. At this time, the curve segments 113*a* and 113*b* overlap each other while intersecting each other at the midpoint $B_1$, and an angle, which is defined by an overlap portion 115 and the center Oi of the base circle Di, equals $\theta i_1$.

As shown in FIG. 2C, the curve segments 113*a* and 113*b* are smoothly connected to each other so as to form a continuous curve that defines the tooth profile of the tooth space 113.

As a result, the circumferential width of the tooth space 113 is less than that of a tooth space which is formed just using the simple hypocycloid curve 117 by an amount corresponding to the angle $\theta i_1$.

As explained above, in the case of the external teeth 111 of the inner rotor 110, the circumferential thickness of the tooth tip 112 is made to be greater and the circumferential width of the tooth space 113 is reduced when compared with the case in which tooth profiles are formed just using the epicycloid curve 116 and the hypocycloid curve 117 that are generated by the circumscribed-rolling circle Ai and the inscribed-rolling circle Bi, respectively.

The distance "$\alpha_1$" between the outer tooth curve segment 112*a* and the outer tooth curve segment 112*b* is set so as to satisfy the following inequality: $t_1/4 \leqq \alpha_1$, and more preferably, the distance "$\alpha_1$" is set so as to satisfy the following inequality: $2t_1/5 \leqq \alpha_1$. As a result, the clearance between the tooth surfaces with respect to the outer rotor 120 are appropriately ensured, and quietness can be sufficiently improved.

Moreover, the distance "$\alpha_1$" between the outer tooth curve segment 112*a* and the outer tooth curve segment 112*b* is set so as to satisfy the following inequality: $\alpha_1 \leqq 3t_1/4$, and more preferably, the distance "$\alpha_1$" is set so as to satisfy the following inequality: $\alpha_1 \leqq 3t_1/5$. As a result, the clearance with respect to the outer rotor 120 is prevented from being too small, and locking in rotation, increase in wear, and reduction in service life of the oil pump rotor assembly can be prevented.

Next, the detailed profile of each of the internal teeth 121 of the outer rotor 120 will be explained with reference to FIGS. 3A to 3C. The internal teeth 121 of the outer rotor 120 are formed by alternately arranging tooth tips 122 and tooth spaces 123 in the circumferential direction.

In order to form the profile of the tooth tip 122, first, the hypocycloid curve 126 (FIG. 3A) generated by the inscribed-rolling circle Bo is equally divided at a midpoint $C_1$ thereof into two segments that are designated by inner tooth curve segments 122*a* and 122*b*, respectively. Here, the midpoint $C_1$ of the hypocycloid curve 126 is a point that symmetrically divides the hypocycloid curve 126 into two which is generated by a specific point on the inscribed-rolling circle Bo by rolling the inscribed-rolling circle Bo by one turn on the base circle Do of the outer rotor 120 without slip. In other words, the midpoint $C_1$ is a point that is reached by the specific point when the inscribed-rolling circle Bo rolls a half turn.

Figure 3A:
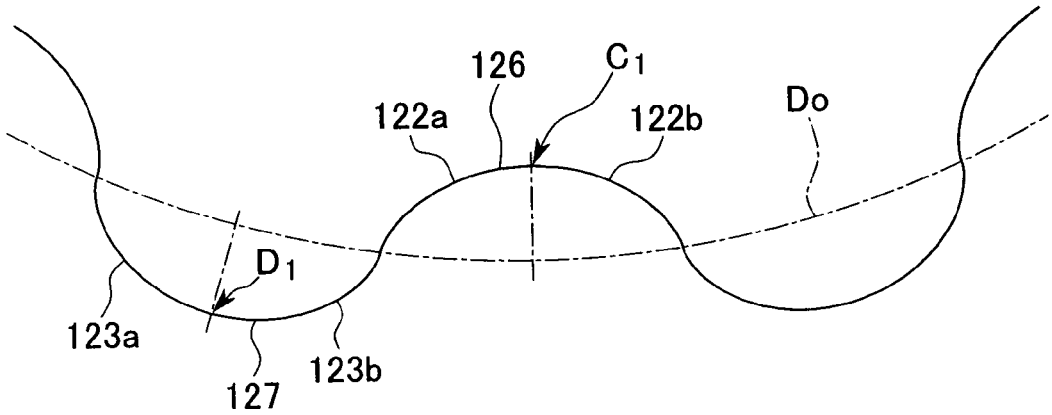
FIGS. 3A to 3C are enlarged views showing the tooth profiles of an outer rotor of the oil pump rotor assembly shown in FIG. 1.
Figure 3B:
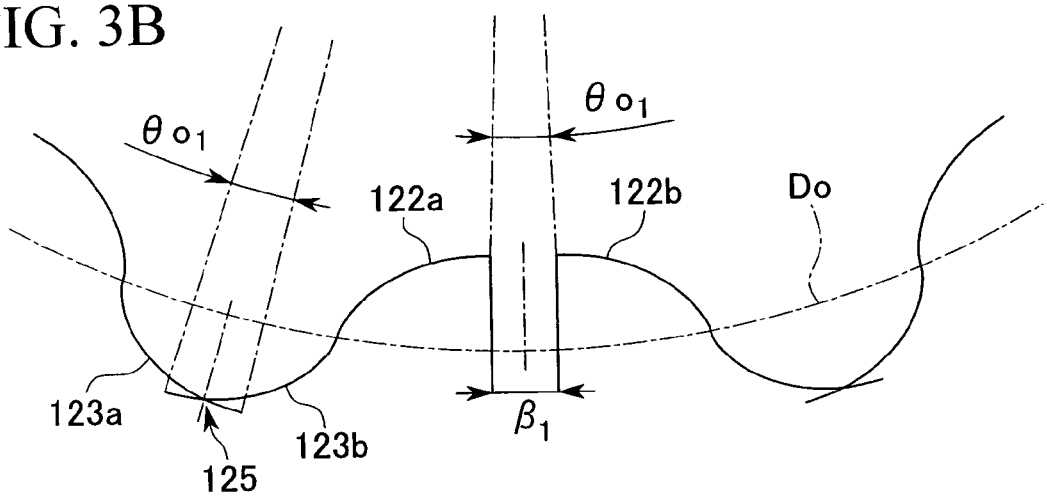

Next, as shown in FIG. 3B, the inner tooth curve segments 122*a* and 122*b* are moved along the circumference of the base circle Do so that a distance "$\beta_1$" is ensured between the inner tooth curve segments 122*a* and 122*b*. Here, an angle defined by two lines, which are drawn by connecting the center Oo of the base circle Do and the ends of the inner tooth curve segments 122*a* and 122*b*, is designated by $\theta o_1$.

Figure 3C:
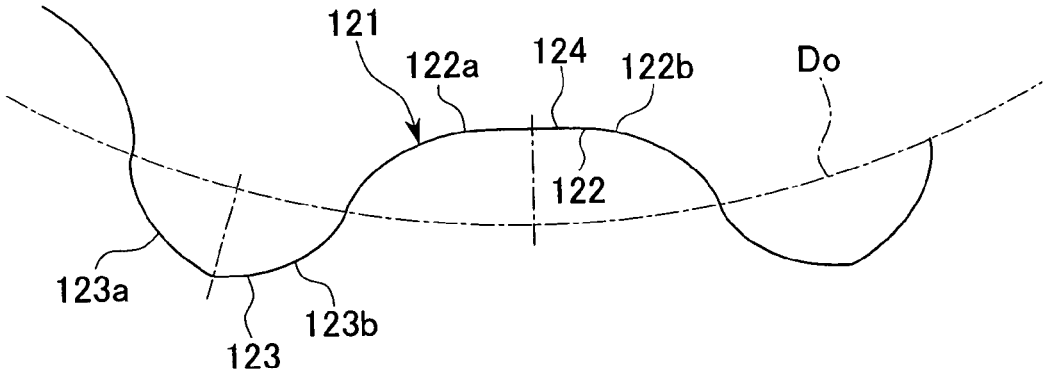

As shown in FIG. 3C, the separated ends of the inner tooth curve segments 122*a* and 122*b* are connected to each other by a complementary line 124 consisting of a straight line, and the obtained continuous curve is used as the profile of the tooth tip 122.

That is, the tooth tip 122 is formed using a continuous curve that includes the inner tooth curve segments 122*a* and 122*b*, which are separated from each other, and the complementary line 124 connecting the inner tooth curve segment 122*a* with the inner tooth curve segment 122*b*.

As a result, the circumferential thickness of the tooth tip 122 is greater than a tooth tip which is formed just using the simple hypocycloid curve 126 by an amount corresponding to the angle $\theta o_1$ defined by two lines, which are drawn by connecting the center Oo of the base circle Do and the ends of the complementary line 124. In this embodiment, the complementary line 124, which connects the inner tooth curve segment 122*a* with the inner tooth curve segment 122*b*, is a straight line; however, the complementary line 124 may be a curve.

The circumferential thickness of the tooth tip 122 is made to be greater than that of a conventional tooth tip as explained above, and on the other hand, in this embodiment, the width of the tooth space 123 is decreased, and tooth profiles are smoothly connected to each other over the entirety of the circumference.

More specifically, in order to form the profile of the tooth space 123, first, the epicycloid curve 127 (FIG. 3A) generated by the circumscribed-rolling circle Ao is equally divided at a midpoint $D_1$ thereof into two segments that are designated by curve segments 123*a* and 123*b*, respectively. Here, the midpoint $D_1$ of the epicycloid curve 127 is a point that symmetrically divides the epicycloid curve 127 into two which is generated by a specific point on the circumscribed-rolling circle Ao by rolling the circumscribed-rolling circle Ao by one turn on the base circle Do of the outer rotor 120 without slip. In other words, the midpoint $D_1$ is a point that is reached by the specific point when the circumscribed-rolling circle Ao rolls a half turn.

Next, as shown in FIG. 3B, the curve segments 123*a* and 123*b* are moved along the circumference of the base circle Do so that the ends of the curve segments 123*a* and 123*b* are respectively connected to the ends of the continuous curve that forms the tooth tip 122. At this time, the curve segments 123*a* and 123*b* overlap each other while intersecting each other at the midpoint $D_1$, and an angle, which is defined by an overlap portion 125 and the center Oo of the base circle Do, equals $\theta o_1$.

As shown in FIG. 3C, the curve segments 123*a* and 123*b* are smoothly connected to each other so as to form a continuous curve that defines the tooth profile of the tooth space 123.

As a result, the circumferential width of the tooth space 123 is less than that of a tooth space which is formed just using the simple epicycloid curve 127 by an amount corresponding to the angle $\theta o_1$.

As explained above, in the case of the internal teeth 121 of the inner rotor 120, the circumferential thickness of the tooth tip 122 is made to be greater and the circumferential width of the tooth space 123 is reduced when compared with the case in which tooth profiles are formed just using epicycloid curve 127 and the hypocycloid curve 126 that are generated by the circumscribed-rolling circle Ao and the inscribed-rolling circle Bo, respectively.

The distance "$\beta_1$" between the outer tooth curve segment 122*a* and the outer tooth curve segment 122*b* is set so as to satisfy the following inequality: $t_1/4 \leqq \beta_1$, and more preferably, the distance "$\beta_1$" is set so as to satisfy the following inequality: $2t_1/5 \leqq \beta_1$. As a result, the clearance between the tooth surfaces with respect to the inner rotor 110 are appropriately ensured, and quietness can be sufficiently improved.

Moreover, the distance "$\beta_1$" between the outer tooth curve segment 122*a* and the outer tooth curve segment 122*b* is set so as to satisfy the following inequality: $\beta_1 \leqq 3t_1/4$, and more preferably, the distance "$\beta_1$" is set so as to satisfy the following inequality: $\beta_1 \leqq 3t_1/5$. As a result, the clearance with respect to the inner rotor 110 is prevented from being too small, and locking in rotation, increase in wear, and reduction in service life of the oil pump rotor assembly can be prevented.

FIG. 1 shows the inner rotor 110 and the outer rotor 120 which are formed according to the following dimensions: øDi=52 mm, øAi=2.5 mm, øBi=2.7 mm, øDo=57.2 mm, øAo=2.56 mm, øBo=2.64 mm, e=2.6 mm, $t_1$=0.12 mm, $\alpha_1$ (the distance between the outer tooth curve segments 112*a* and 112*b*)=$\beta_1$ (the inner tooth curve segments 122*a* and 122*b*)=$t_1/2$ (=0.06 mm).

Because "$\alpha_1$" and "$\beta_1$", i.e., the amounts of movement of the tooth curve segments are too small to be shown in linear scale, they are greatly enlarged in FIGS. 2A to 2C, and in FIGS. 3A to 3C in order to explain the detailed profiles of the tooth surfaces; therefore, the tooth profiles shown in FIGS. 2A to 2C, and in FIGS. 3A to 3C are distorted when compared with the actual tooth profiles shown in FIG. 1.

In the above embodiment, the circumferential thicknesses of both tooth tip 112 of the inner rotor 110 and tooth tip 122 of the outer rotor 120 are increased when compared with conventional cases; however, the present invention is not limited to this, and other configurations may be employed in which one of the tooth tip 112 of the inner rotor 110 and tooth tip 122 of the outer rotor 120 is made thicker, and the tooth profile of the other tooth tip is formed using a cycloid curve without modification.

Moreover, as another embodiment derived from the above first embodiment, other curves may be employed as the base tooth curves to which the above-mentioned correction is applied, so that the following relationships are satisfied between the inner rotor 110 and the outer rotor 120.

With regard to the base curves that define tooth profiles of the inner rotor 110, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi \cdot øDi = n \cdot \pi \cdot (øAi + øBi), \text{ i.e.,}$$

$$øDi = n \cdot (øAi + øBi).$$

Similarly, with regard to the base curves that define tooth profiles of the outer rotor 120, because the length of circumference of the base circle Do of the outer rotor 120 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi \cdot øDo = (n+1) \cdot \pi \cdot (øAo + øBo), \text{ i.e.,}$$

$$øDo = (n+1) \cdot (øAo + øBo).$$

Next, in order to ensure an appropriate clearance between the center of the tooth space of the inner rotor 110 and the center of the tooth tip of the outer rotor 120, the following equation is satisfied between the inscribed-rolling circles Bi and Bo:

$$øBi = øBo,$$

and with regard to the base circle Do of the outer rotor 120, the following equation is satisfied:

$$øDo = øDi \cdot (n+1)/n + t_1 \cdot (n+1)/(n+2).$$

Moreover, with regard to the circumscribed-rolling circle Ao, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øAo = øAi + t_1/(n+2).$$

The oil pump rotor assembly of the present invention may be formed using the base curves that satisfy the above relationships.

Furthermore, as another embodiment derived from the above first embodiment, other curves may be employed as the base tooth curves to which the above-mentioned correction is applied, so that the following relationships are satisfied between the inner rotor 110 and the outer rotor 120.

With regard to the base curves that define tooth profiles of the inner rotor 110, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi \cdot øDi = n \cdot \pi \cdot (øAi + øBi), \text{ i.e.,}$$

$$øDi = n \cdot (øAi + øBi).$$

Similarly, with regard to the base curves that define tooth profiles of the outer rotor 120, because the length of circumference of the base circle Do of the outer rotor 120 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi \cdot øDo = (n+1) \cdot \pi \cdot (øAo + øBo), \text{ i.e.,}$$

$$øDo = (n+1) \cdot (øAo + øBo).$$

Next, in order to ensure an appropriate clearance between the center of the tooth tip of the inner rotor 110 and the center of the tooth space of the outer rotor 120, the following equation is satisfied between the circumscribed-rolling circles Ai and Ao:

$$øAi=øAo,$$

and with regard to the base circle Do of the outer rotor 120, the following equation is satisfied:

$$øDo=øDi\cdot(n+1)/n+t_1\cdot(n+1)/(n+2).$$

Moreover, with regard to the inscribed-rolling circle Bo, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øBo=øBi+t_1/(n+2).$$

The oil pump rotor assembly of the present invention may be formed using the base curves that satisfy the above relationships.

Second Embodiment

A second embodiment of an oil pump rotor assembly according to the present invention will be explained below with reference to FIGS. 4 to 6C.

Figure 4:
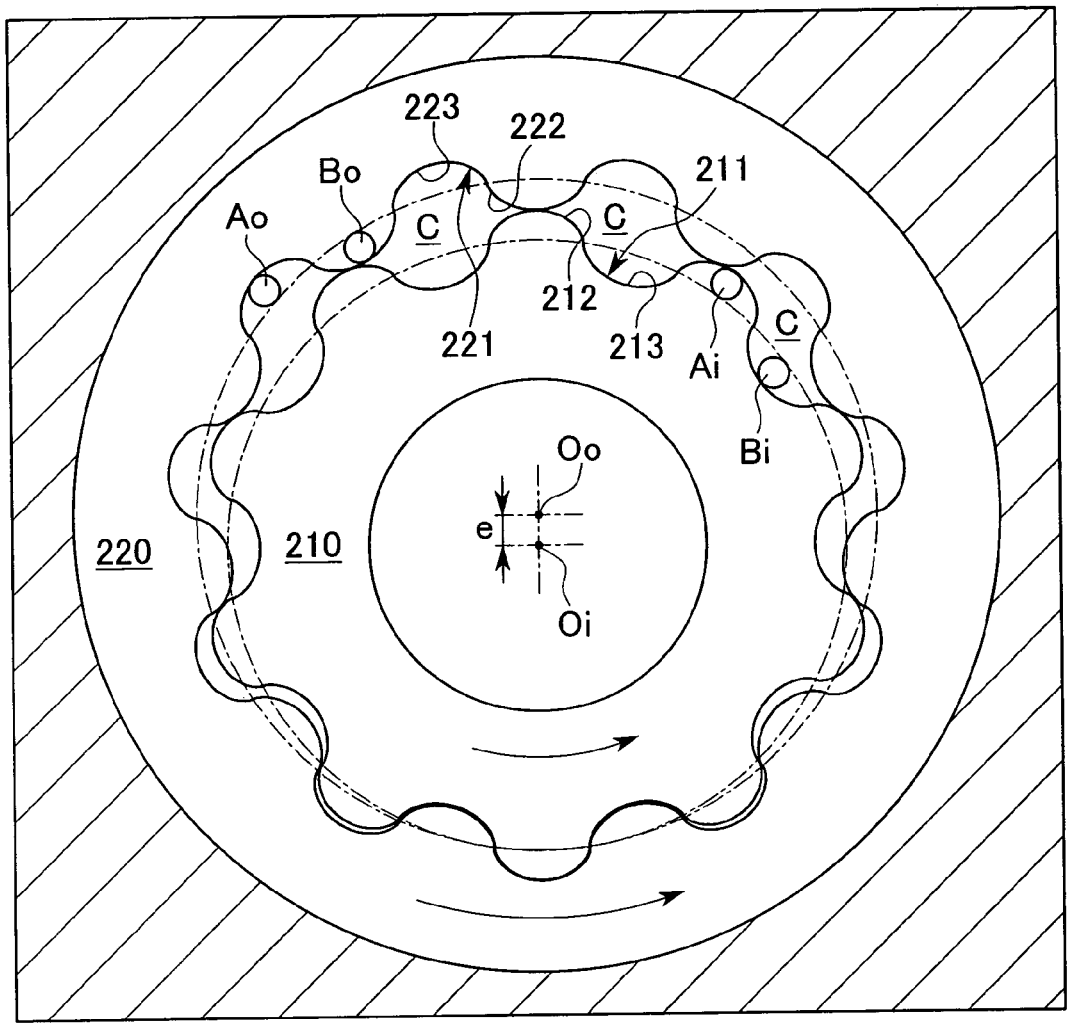
FIG. 4 is a diagram showing a second embodiment of an oil pump rotor assembly according to the present invention.

The oil pump shown in FIG. 4 comprises an inner rotor 210 provided with "n" external teeth 211 ("n" indicates a natural number, and n=10 in this embodiment), an outer rotor 220 provided with "n+1" internal teeth 221 (n+1=11 in this embodiment) which are engageable with the external teeth 211, and a casing 30 which accommodates the inner rotor 210 and the outer rotor 220.

Between the tooth surfaces of the inner rotor 210 and outer rotor 220, there are formed plural cells C in the direction of rotation of the inner rotor 210 and outer rotor 220. Each of the cells C is delimited at a front portion and at a rear portion as viewed in the direction of rotation of the inner rotor 210 and outer rotor 220 by contact regions between the external teeth 211 of the inner rotor 210 and the internal teeth 221 of the outer rotor 220, and is also delimited at either side portions by the casing 30, so that an independent fluid conveying chamber is formed. Each of the cells C moves while the inner rotor 210 and outer rotor 220 rotate, and the volume of each of the cells C cyclically increases and decreases so as to complete one cycle in a rotation.

In the casing 30, there are formed a suction port, which communicates with one of the cells C whose volume increases gradually, and a discharge port, which communicates with one of the cells C whose volume decreases gradually, and fluid drawn into one of the cells C through the suction port is transported as the rotors 210 and 220 rotate, and is discharged through the discharge port.

A clearance that is formed between the apex of the tooth tip 212 of the inner rotor 210 and the apex of the tooth tip 222 of the outer rotor 220, which face each other on a line passing through the centers Oi and Oo of the rotors, is designated by a tip clearance. The size "$t_2$" of this tip clearance is defined as the size of a tip clearance that is formed in a state in which the rotors 210 and 220 are disposed such that clearance between the tooth tip 212 of the inner rotor 210 and the tooth space 223 of the outer rotor 220, which engage each other on the line passing through the centers Oi and Oo at a diametrically opposing position, is zero.

When the rotors are driven, the center Oi of the inner rotor 210 and the center Oo of the outer rotor 220 are disposed to have an eccentric distance therebetween so that the same clearance $t_2/2$ is formed between the tooth surfaces at two positions, located on the line passing through the centers Oi and Oo, at which the tooth surfaces face each other. The eccentric distance between the centers Oi and Oo is designated by "e".

The inner rotor 210 is mounted on a rotational axis so as to be rotatable about the center Oi, and the tooth profile of each of the external teeth 211 of the inner rotor 210 is formed using an epicycloid curve 216, which is generated by rolling a circumscribed-rolling circle Ai (whose diameter is øAi) along the base circle Di (whose diameter is øDi) of the inner rotor 210 without slip, and using a hypocycloid curve 217, which is generated by rolling an inscribed-rolling circle Bi (whose diameter is øBi) along the base circle Di without slip.

The outer rotor 220 is mounted so as to be rotatable about the center Oo, and the center thereof is positioned so as to have an offset (the eccentric distance is "e") from the center Oi. The tooth profile of each of the internal teeth 221 of the outer rotor 220 is formed using an epicycloid curve 227, which is generated by rolling a circumscribed-rolling circle Ao (whose diameter is øAo) along the base circle Do (whose diameter is øDo) of the outer rotor 220 without slip, and using a hypocycloid curve 226, which is generated by rolling an inscribed-rolling circle Bo (whose diameter is øBo) along the base circle Do without slip.

The equations which will be discussed below are to be satisfied between the inner rotor 210 and the outer rotor 220. Note that dimensions will be expressed in millimeters.

With regard to the base curves that define tooth profiles of the inner rotor 210, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi\cdot øDi=n\cdot\pi\cdot(øAi+øBi),\text{ i.e.,}$$

$$øDi=n\cdot(øAi+øBi) \quad \text{(I).}$$

Similarly, with regard to the base curves that define tooth profiles of the outer rotor 220, because the length of circumference of the base circle Do of the outer rotor 220 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi\cdot øDo=(n+1)\cdot\pi\cdot(øAo+øBo),\text{ i.e.,}$$

$$øDo=(n+1)\cdot(øAo+øBo) \quad \text{(II).}$$

Next, since the inner rotor 210 engages the outer rotor 220, $$øAi+øBi=øAo+øBo=2e \quad \text{(III).}$$

Based on the above equations (I), (II), and (III), $$(n+1)\cdot øDi=n\cdot øDo \quad \text{(IV).}$$

Moreover, with regard to the tip clearance which is formed between the apex of the tooth tip 212 of the external tooth 211 and the apex of the tooth tip 222 of the internal tooth 221 in a rotational phase advancing by 180° from a rotational phase in which the apexes face each other, the following equations are satisfied:

$$øAi+t_2/2=øAo \quad \text{(V); and}$$

$$øBi-t_2/2=øBo \quad \text{(VI).}$$

The detailed profile of each of the external teeth 211 of the inner rotor 210 will be explained with reference to FIGS. 5A to 5C. The external teeth 211 of the inner rotor 210 are formed by alternately arranging tooth tips 212 and tooth spaces 213 in the circumferential direction.

In order to form the profile of the tooth tip 212, first, the epicycloid curve 216 (FIG. 5A) generated by the circumscribed-rolling circle Ai is equally divided at a midpoint $A_2$ thereof into two segments that are designated by outer tooth curve segments 212*a* and 212*b*, respectively.

Figure 5A:
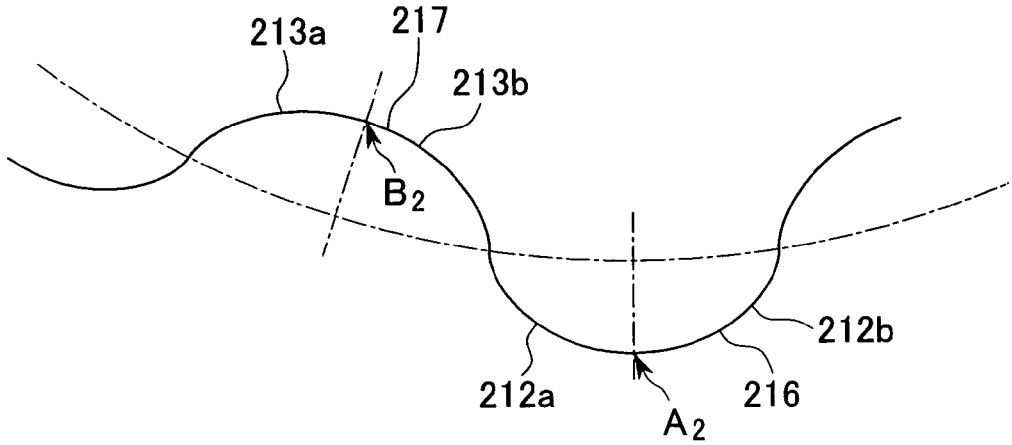
FIGS. 5A to 5C are enlarged views showing the tooth profiles of an inner rotor of the oil pump rotor assembly shown in FIG. 4.
Figure 5B:
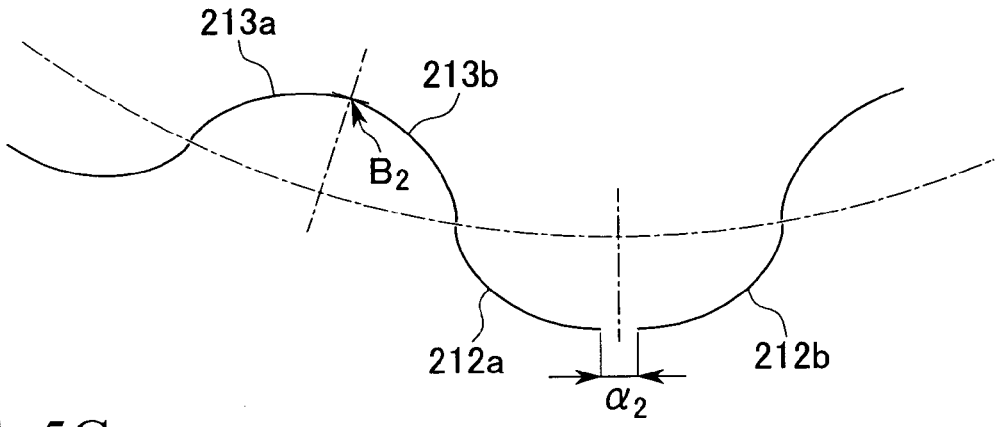

Next, as shown in FIG. 5B, the outer tooth curve segments 212*a* and 212*b* are moved in the direction of a tangent of the epicycloid curve 216 drawn at the midpoint $A_2$ thereof so that a distance "$\alpha_2$" is ensured between the outer tooth curve segments 212*a* and 212*b*.

Figure 5C:
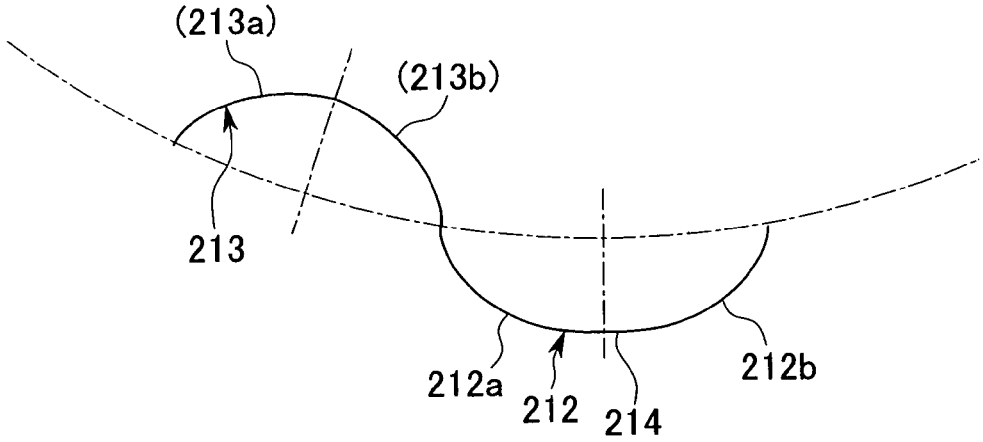

As shown in FIG. 5C, the separated ends of the outer tooth curve segments 212*a*and 212*b* are connected to each other by a complementary line 214 consisting of a straight line, and the obtained continuous curve is used as the profile of the tooth tip 212.

That is, the tooth tip 212 is formed using a continuous curve that includes the outer tooth curve segments 212*a* and 212*b*, which are separated from each other, and the complementary line 214 connecting the outer tooth curve segment 212*a* with the outer tooth curve segment 212*b*.

As a result, the circumferential thickness of the tooth tip 212 of the inner rotor 210 is greater than a tooth tip which is formed just using the simple epicycloid curve 216 by an amount corresponding to the interposing complementary line 214. In this embodiment, the complementary line 214, which connects the outer tooth curve segment 212*a* with the outer tooth curve segment 212*b*, is a straight line; however, the complementary line 214 may be a curve.

The circumferential thickness of the tooth tip 212 is made to be greater than that of a conventional tooth tip as explained above, and on the other hand, in this embodiment, the width of the tooth space 213 is decreased, and tooth profiles are smoothly connected to each other over the entirety of the circumference.

More specifically, in order to form the profile of the tooth space 213, first, the hypocycloid curve 217 (FIG. 5A) generated by the inscribed-rolling circle Bi is equally divided at a midpoint $B_2$ thereof into two segments that are designated by curve segments 213*a* and 213*b*, respectively.

Next, as shown in FIG. 5B, the curve segments 213*a* and 213*b* are moved in the direction of a tangent of the hypocycloid curve 217 drawn at the midpoint $B_2$ thereof so that the ends of the curve segments 213*a* and 213*b* are respectively connected to the ends of the continuous curve that forms the tooth tip 212. At this time, the curve segments 213*a* and 213*b* overlap each other while intersecting each other at the midpoint $B_2$.

As shown in FIG. 5C, the curve segments 213*a* and 213*b* are smoothly connected to each other so as to form a continuous curve that defines the tooth profile of the tooth space 213.

As a result, the circumferential width of the tooth space 213 is less than that of a tooth space which is formed just using the simple hypocycloid curve 217 by an amount corresponding to the complementary line 214 interposing in the tooth tip 212.

As explained above, in the case of the external teeth 211 of the inner rotor 210, the circumferential thickness of the tooth tip 212 is made to be greater and the circumferential width of the tooth space 213 is reduced when compared with the case in which tooth profiles are formed just using the epicycloid curve 216 and the hypocycloid curve 217 that are generated by the circumscribed-rolling circle Ai and the inscribed-rolling circle Bi, respectively.

The distance "$\alpha_2$" between the outer tooth curve segment 212*a* and the outer tooth curve segment 212*b* is set so as to satisfy the following inequality: $t_2/4 \leqq \alpha_2$, and more preferably, the distance "$\alpha_2$" is set so as to satisfy the following inequality: $2t_2/5 \leqq \alpha_2$. As a result, the clearance between the tooth surfaces with respect to the outer rotor 220 are appropriately ensured, and quietness can be sufficiently improved.

Moreover, the distance "$\alpha_2$" between the outer tooth curve segment 212*a* and the outer tooth curve segment 212*b* is set so as to satisfy the following inequality: $\alpha_2 \leqq 3t_2/4$, and more preferably, the distance "$\alpha_2$" is set so as to satisfy the following inequality: $\alpha_2 \leqq 3t_2/5$. As a result, the clearance with respect to the outer rotor 220 is prevented from being too small, and locking in rotation, increase in wear, and reduction in service life of the oil pump rotor assembly can be prevented.

Next, the detailed profile of each of the internal teeth 221 of the outer rotor 220 will be explained with reference to FIGS. 6A to 6C. The internal teeth 221 of the outer rotor 220 are formed by alternately arranging tooth tips 222 and tooth spaces 223 in the circumferential direction.

In order to form the profile of the tooth tip 222, first, the hypocycloid curve 226 (FIG. 6A) generated by the inscribed-rolling circle Bo is equally divided at a midpoint $C_2$ thereof into two segments that are designated by inner tooth curve segments 222*a* and 222*b*, respectively.

Figure 6A:
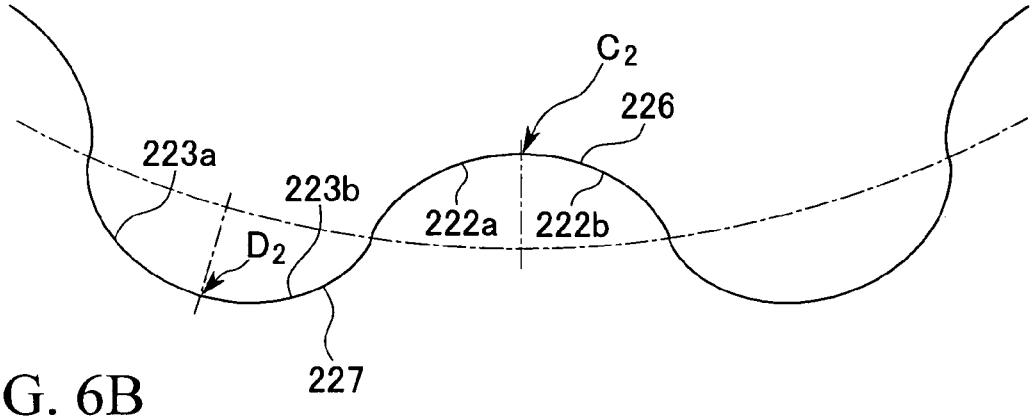
FIGS. 6A to 6C are enlarged views showing the tooth profiles of an outer rotor of the oil pump rotor assembly shown in FIG. 4.
Figure 6B:
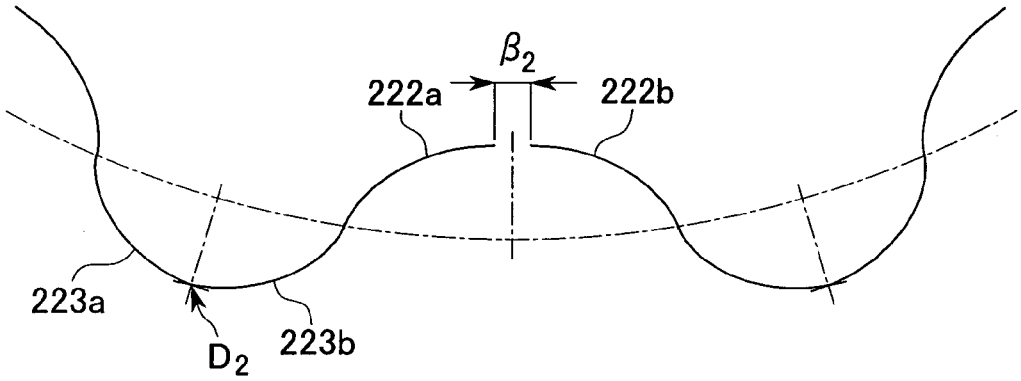

Next, as shown in FIG. 6B, the inner tooth curve segments 222*a* and 222*b* are moved in the direction of a tangent of the hypocycloid curve 226 drawn at the midpoint $C_2$ thereof so that a distance "$\beta_2$" is ensured between the inner tooth curve segments 222*a* and 222*b*.

Figure 6C:
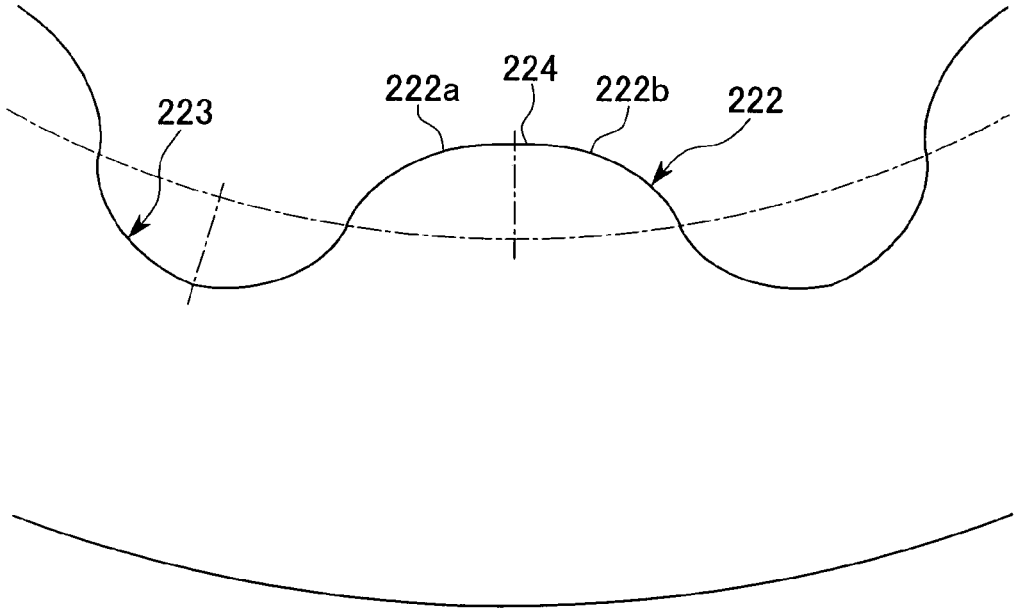

As shown in FIG. 6C, the separated ends of the inner tooth curve segments 222*a* and 222*b* are connected to each other by a complementary line 224 consisting of a straight line, and the obtained continuous curve is used as the profile of the tooth tip 222.

That is, the tooth tip 222 is formed using a continuous curve that includes the inner tooth curve segments 222*a* and 222*b*, which are separated from each other, and the complementary line 224 connecting the inner tooth curve segment 222*a* with the inner tooth curve segment 222*b*.

As a result, the circumferential thickness of the tooth tip 222 is greater than a tooth tip which is formed just using the simple hypocycloid curve 226 by an amount corresponding to the interposing complementary line 224. In this embodiment, the complementary line 224, which connects the inner tooth curve segment 222*a* with the inner tooth curve segment 222*b*, is a straight line; however, the complementary line 224 may be a curve.

The circumferential thickness of the tooth tip 222 is made to be greater than that of a conventional tooth tip as explained above, and on the other hand, in this embodiment, the width of the tooth space 223 is decreased, and tooth profiles are smoothly connected to each other over the entirety of the circumference.

More specifically, in order to form the profile of the tooth space 223, first, the epicycloid curve 227 (FIG. 6A) generated by the circumscribed-rolling circle Ao is equally divided at a midpoint $D_2$ thereof into two segments that are designated by curve segments 223*a* and 223*b*, respectively.

Next, as shown in FIG. 6B, the curve segments 223*a* and 223*b* are moved in the direction of a tangent of the epicycloid curve 227 drawn at the midpoint $D_2$ thereof so that the ends of the curve segments 223*a* and 223*b* are respectively connected to the ends of the continuous curve that forms the tooth tip 222, and the curve segments 223*a* and 223*b* overlap each other while intersecting each other at the midpoint $D_2$.

As shown in FIG. 6C, the curve segments 223*a* and 223*b* are smoothly connected to each other so as to form a continuous curve that defines the tooth profile of the tooth space 223.

As a result, the circumferential width of the tooth space 223 is less than that of a tooth space which is formed just using the simple epicycloid curve 227 by an amount corresponding to the complementary line 224 interposing in the tooth tip 222.

As explained above, in the case of the internal teeth 221 of the inner rotor 220, the circumferential thickness of the tooth tip 222 is made to be greater and the circumferential width of the tooth space 223 is reduced when compared with the case in which tooth profiles are formed just using the epicycloid curve 227 and the hypocycloid curve 226 that are generated by the circumscribed-rolling circle Ao and the inscribed-rolling circle Bo, respectively.

The distance "$\beta_2$" between the outer tooth curve segment 222*a* and the outer tooth curve segment 222*b* is set so as to satisfy the following inequality: $t_2/4 \leqq \beta_2$, and more preferably, the distance "$\beta_2$" is set so as to satisfy the following inequality: $2t_2/5 \leqq \beta_2$. As a result, the clearance between the tooth surfaces with respect to the inner rotor 210 are appropriately ensured, and quietness can be sufficiently improved.

Moreover, the distance "$\beta_2$" between the outer tooth curve segment 222*a* and the outer tooth curve segment 222*b* is set so as to satisfy the following inequality: $\beta_2 \leqq 3t_2/4$, and more preferably, the distance "$\beta_2$" is set so as to satisfy the following inequality: $\beta_2 \leqq 3t_2/5$. As a result, the clearance with respect to the inner rotor 210 is prevented from being too small, and locking in rotation, increase in wear, and reduction in service life of the oil pump rotor assembly can be prevented.

FIG. 4 shows the inner rotor 210 and the outer rotor 220 which are formed according to the following dimensions: øDi=52 mm, øAi=2.5 mm, øBi=2.7 mm, øDo=57.2 mm, øAo=2.56 mm, øBo=2.64 mm, e=2.6 mm, $t_2$=0.12 mm, $\alpha_2$ (the distance between the outer tooth curve segments 212*a* and 212*b*)=$\beta_2$ (the inner tooth curve segments 222*a* and 222*b*)=$t_2/2$ (=0.06 mm).

Because "$\alpha_2$" and "$\beta_2$", i.e., the amounts of movement of the tooth curve segments are too small to be shown in linear scale, they are greatly enlarged in FIGS. 5A to 5C, and in FIGS. 6A to 6C in order to explain the detailed profiles of the tooth surfaces; therefore, the tooth profiles shown in FIGS. 5A to 5C, and in FIGS. 6A to 6C are distorted when compared with the actual tooth profiles shown in FIG. 4.

In the above embodiment, the circumferential thicknesses of both tooth tip 212 of the inner rotor 210 and tooth tip 222 of the outer rotor 220 are increased when compared with conventional cases; however, the present invention is not limited to this, and other configurations may be employed in which one of the tooth tip 212 of the inner rotor 210 and tooth tip 222 of the outer rotor 220 is made thicker, and the tooth profile of the other tooth tip is formed using a cycloid curve without modification.

Moreover, as another embodiment derived from the above second embodiment, other curves may be employed as the base tooth curves to which the above-mentioned correction is applied, so that the following relationships are satisfied between the inner rotor 210 and the outer rotor 220.

With regard to the base curves that define tooth profiles of the inner rotor 210, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi \cdot øDi = n \cdot \pi \cdot (øAi + øBi), \text{ i.e.,}$$

$$øDi = n \cdot (øAi + øBi).$$

Similarly, with regard to the base curves that define tooth profiles of the outer rotor 220, because the length of circumference of the base circle Do of the outer rotor 220 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi \cdot øDo = (n+1) \cdot \pi \cdot (øAo + øBo), \text{ i.e.,}$$

$$øDo = (n+1) \cdot (øAo + øBo).$$

Next, in order to ensure an appropriate clearance between the center of the tooth space of the inner rotor 210 and the center of the tooth tip of the outer rotor 220, the following equation is satisfied between the inscribed-rolling circles Bi and Bo:

$$øBi = øBo,$$

and with regard to the base circle Do of the outer rotor 220, the following equation is satisfied:

$$øDo = øDi \cdot (n+1)/n + t_2 \cdot (n+1)/(n+2).$$

Moreover, with regard to the circumscribed-rolling circle Ao, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øAo = øAi + t_2/(n+2).$$

The oil pump rotor assembly of the present invention may be formed using the base curves that satisfy the above relationships.

Furthermore, as another embodiment derived from the above second embodiment, other curves may be employed as the base tooth curves to which the above-mentioned correction is applied, so that the following relationships are satisfied between the inner rotor 210 and the outer rotor 220.

With regard to the base curves that define tooth profiles of the inner rotor 210, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi \cdot øDi = n \cdot \pi \cdot (øAi + øBi), \text{ i.e.,}$$

$$øDi = n \cdot (øAi + øBi).$$

Similarly, with regard to the base curves that define tooth profiles of the outer rotor 220, because the length of circumference of the base circle Do of the outer rotor 220 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi\cdot øDo=(n+1)\cdot\pi\cdot(øAo+øBo), \text{ i.e.,}$$

$$øDo=(n+1)\cdot(øAo+øBo).$$

Next, in order to ensure an appropriate clearance between the center of the tooth tip of the inner rotor 210 and the center of the tooth space of the outer rotor 220, the following equation is satisfied between the circumscribed-rolling circles Ai and Ao:

$$øAi=øAo,$$

and with regard to the base circle Do of the outer rotor 220, the following equation is satisfied:

$$øDo=øDi\cdot(n+1)/n+t_2\cdot(n+1)/(n+2).$$

Moreover, with regard to the inscribed-rolling circle Bo, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øBo=øBi+t_2/(n+2).$$

The oil pump rotor assembly of the present invention may be formed using the base curves that satisfy the above relationships.

Third Embodiment

A third embodiment of an oil pump rotor assembly according to the present invention will be explained below with reference to FIGS. 7 to 9D.

Figure 7:
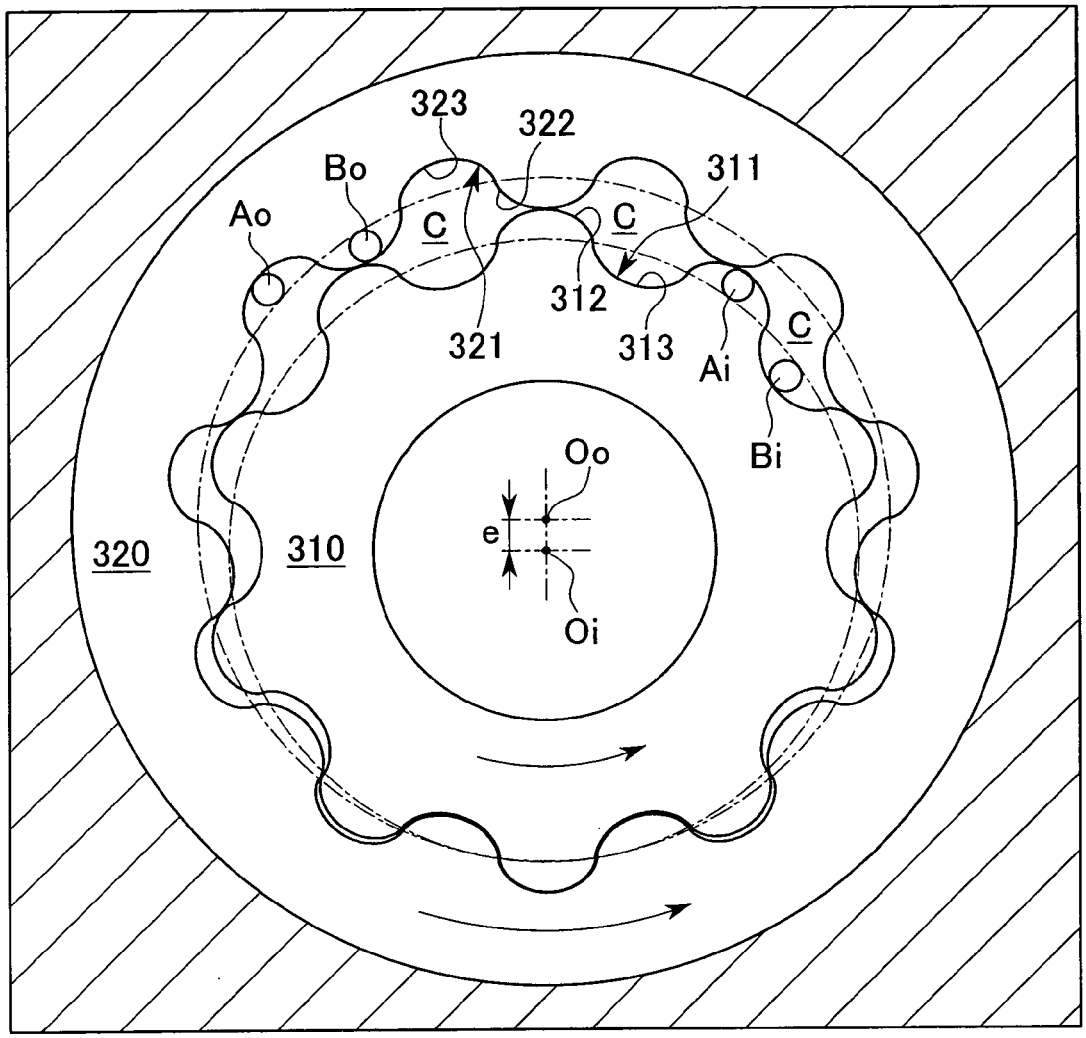
FIG. 7 is a diagram showing a third embodiment of an oil pump rotor assembly according to the present invention.

The oil pump shown in FIG. 7 comprises an inner rotor 310 provided with "n" external teeth 311 ("n" indicates a natural number, and n=10 in this embodiment), an outer rotor 320 provided with "n+1" internal teeth 321 (n+1=11 in this embodiment) which are engageable with the external teeth 311, and a casing 30 which accommodates the inner rotor 310 and the outer rotor 320.

Between the tooth surfaces of the inner rotor 310 and outer rotor 320, there are formed plural cells C in the direction of rotation of the inner rotor 310 and outer rotor 320. Each of the cells C is delimited at a front portion and at a rear portion as viewed in the direction of rotation of the inner rotor 310 and outer rotor 320 by contact regions between the external teeth 311 of the inner rotor 310 and the internal teeth 321 of the outer rotor 320, and is also delimited at either side portions by the casing 30, so that an independent fluid conveying chamber is formed. Each of the cells C moves while the inner rotor 310 and outer rotor 320 rotate, and the volume of each of the cells C cyclically increases and decreases so as to complete one cycle in a rotation.

In the casing 30, there are formed a suction port, which communicates with one of the cells C whose volume increases gradually, and a discharge port, which communicates with one of the cells C whose volume decreases gradually, and fluid drawn into one of the cells C through the suction port is transported as the rotors 310 and 320 rotate, and is discharged through the discharge port.

A clearance that is formed between the apex of the tooth tip 312 of the inner rotor 310 and the apex of the tooth tip 322 of the outer rotor 320, which face each other on a line passing through the centers Oi and Oo of the rotors, is designated by a tip clearance. The size "$t_3$" of this tip clearance is defined as the size of a tip clearance that is formed in a state in which the rotors 310 and 320 are disposed such that clearance between the tooth tip 312 of the inner rotor 310 and the tooth space 323 of the outer rotor 320, which engage each other on the line passing through the centers Oi and Oo at a diametrically opposing position, is zero.

When the rotors are driven, the center Oi of the inner rotor 310 and the center Oo of the outer rotor 320 are disposed to have an eccentric distance therebetween so that the same clearance $t_3/2$ is formed between the tooth surfaces at two positions, located on the line passing through the centers Oi and Oo, at which the tooth surfaces face each other. The eccentric distance between the centers Oi and Oo is designated by "e".

The inner rotor 310 is mounted on a rotational axis so as to be rotatable about the center Oi, and the tooth profile of each of the external teeth 311 of the inner rotor 310 is formed using an epicycloid curve 316, which is generated by rolling a circumscribed-rolling circle Ai (whose diameter is øAi) along the base circle Di (whose diameter is øDi) of the inner rotor 310 without slip, and using a hypocycloid curve 317, which is generated by rolling an inscribed-rolling circle Bi (whose diameter is øBi) along the base circle Di without slip.

The outer rotor 320 is mounted so as to be rotatable about the center Oo, and the center thereof is positioned so as to have an offset (the eccentric distance is "e") from the center Oi. The tooth profile of each of the internal teeth 321 of the outer rotor 320 is formed using an epicycloid curve 327, which is generated by rolling a circumscribed-rolling circle Ao (whose diameter is øAo) along the base circle Do (whose diameter is øDo) of the outer rotor 320 without slip, and using a hypocycloid curve 326, which is generated by rolling an inscribed-rolling circle Bo (whose diameter is øBo) along the base circle Do without slip.

The equations which will be discussed below are to be satisfied between the inner rotor 310 and the outer rotor 320. Note that dimensions will be expressed in millimeters.

With regard to the base curves that define tooth profiles of the inner rotor 310, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi\cdot øDi=n\cdot\pi\cdot(øAi+øBi), \text{ i.e.,}$$

$$øDi=n\cdot(øAi+øBi) \quad \text{(I).}$$

Similarly, with regard to the base curves that define tooth profiles of the outer rotor 320, because the length of circumference of the base circle Do of the outer rotor 320 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi\cdot øDo=(n+1)\cdot\pi\cdot(øAo+øBo), \text{ i.e.,}$$

$$øDo=(n+1)\cdot(øAo+øBo) \quad \text{(II).}$$

Next, since the inner rotor 310 engages the outer rotor 320, $$øAi+øBi=øAo+øBo=2e \quad \text{(III).}$$

Based on the above equations (I), (II), and (III), $$(n+1)\cdot øDi=n\cdot øDo \quad \text{(IV).}$$

Moreover, with regard to the tip clearance which is formed between the apex of the tooth tip 312 of the external tooth 311 and the apex of the tooth tip 322 of the internal tooth 321 in a rotational phase advancing by 180° from a rotational phase in which the apexes face each other, the following equations are satisfied:

$$øAi+t_3/2=øAo \quad \text{(V); and}$$

$$øBi-t_3/2=øBo \quad \text{(VI).}$$

The detailed profile of each of the external teeth 311 of the inner rotor 310 will be explained with reference to FIGS. 8A to 8D. The external teeth 311 of the inner rotor 310 are formed by alternately arranging tooth tips 312 and tooth spaces 313 in the circumferential direction.

In order to form the profile of the tooth tip 312, first, the epicycloid curve 316 (FIG. 8A) generated by the circumscribed-rolling circle Ai is equally divided at a midpoint $A_3$ thereof into two segments that are designated by outer tooth curve segments 312*a* and 312*b*, respectively.

Figure 8A:
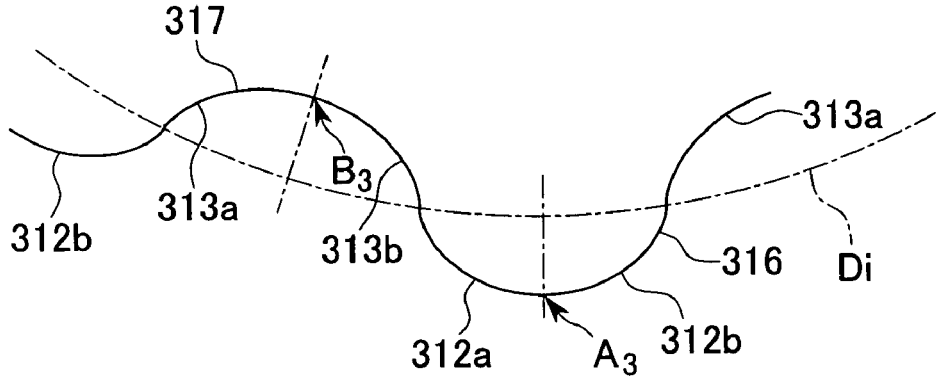
FIGS. 8A to 8D are enlarged views showing the tooth profiles of an inner rotor of the oil pump rotor assembly shown in FIG. 7.
Figure 8B:
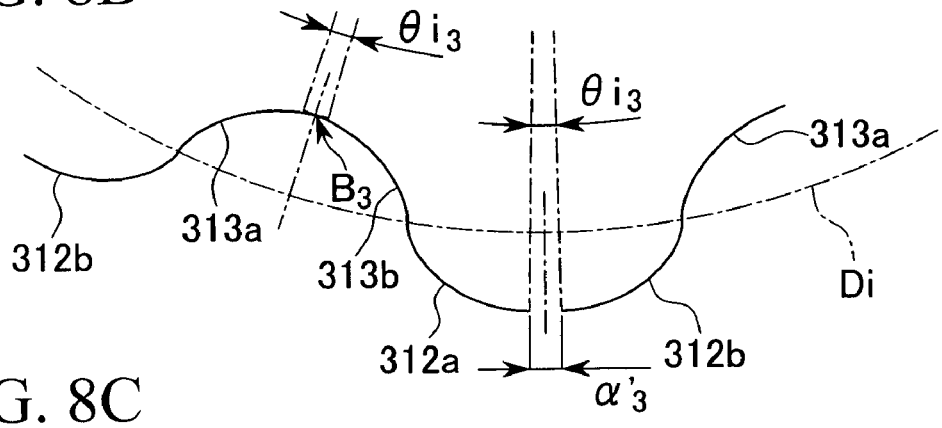

Next, as shown in FIG. 8B, the outer tooth curve segments 312*a* and 312*b* are moved about the center Oi and along the circumference of the base circle Di by an amount of angle $\theta i_3$ so that a distance "$\alpha'_3$" is ensured between the outer tooth curve segments 312*a* and 312*b*.

Figure 8C:
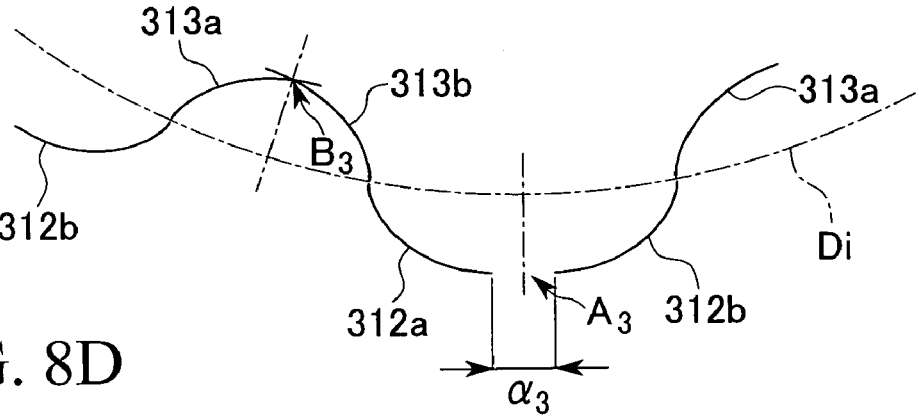

Moreover, as shown in FIG. 8C, the outer tooth curve segments 312*a* and 312*b* are moved in the direction of a tangent of the epicycloid curve 316 drawn at the midpoint $A_3$ thereof so that a distance "$\alpha_3$" is ensured between the outer tooth curve segments 312*a* and 312*b*.

Figure 8D:
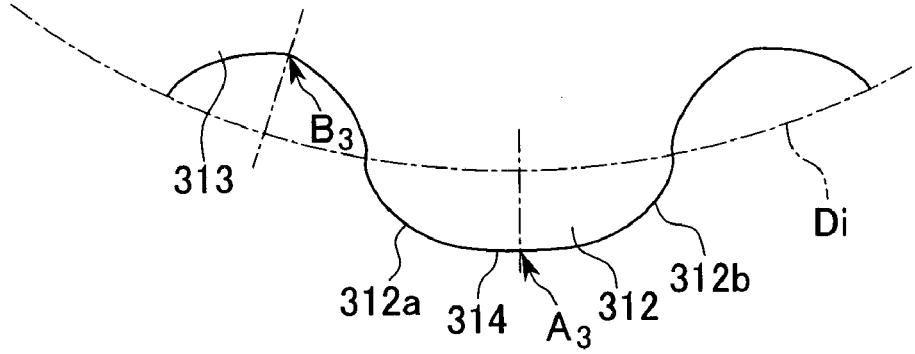

As shown in FIG. 8D, the separated ends of the outer tooth curve segments 312*a* and 312*b* are connected to each other by a complementary line 314 consisting of a straight line, and the obtained continuous curve is used as the profile of the tooth tip 312.

That is, the tooth tip 312 is formed using a continuous curve that includes the outer tooth curve segments 312*a* and 312*b*, which are separated from each other, and the complementary line 314 connecting the outer tooth curve segment 312*a* with the outer tooth curve segment 312*b*.

As a result, the circumferential thickness of the tooth tip 312 of the inner rotor 310 is greater than a tooth tip which is formed just using the simple epicycloid curve 316 by an amount corresponding to the interposing complementary line 314. In this embodiment, the complementary line 314, which connects the outer tooth curve segment 312*a* with the outer tooth curve segment 312*b*, is a straight line; however, the complementary line 314 may be a curve.

The circumferential thickness of the tooth tip 312 is made to be greater than that of a conventional tooth tip as explained above, and on the other hand, in this embodiment, the width of the tooth space 313 is decreased, and tooth profiles are smoothly connected to each other over the entirety of the circumference.

More specifically, in order to form the profile of the tooth space 313, first, the hypocycloid curve 317 (FIG. 8A) generated by the inscribed-rolling circle Bi is equally divided at a midpoint $B_3$ thereof into two segments that are designated by curve segments 313*a* and 313*b*, respectively.

Next, as shown in FIG. 8B, the curve segments 313*a* and 313*b* are moved along the circumference of the base circle Di so that the ends of the curve segments 313*a* and 313*b* are respectively connected to the ends of the continuous curve that forms the tooth tip 312. As a result, the curve segments 313*a* and 313*b* overlap each other while intersecting each other at the midpoint $B_3$.

Moreover, as shown in FIG. 8C, the curve segments 313*a* and 313*b* are moved in the direction of a tangent of the hypocycloid curve 317 drawn at the midpoint $B_3$ thereof so that the ends of the curve segments 313*a* and 313*b* are respectively connected to the ends of the continuous curve that forms the tooth tip 312.

As shown in FIG. 8D, the curve segments 313*a* and 313*b* are smoothly connected to each other so as to form a continuous curve that defines the tooth profile of the tooth space 313.

As a result, the circumferential width of the tooth space 313 is less than that of a tooth space which is formed just using the simple hypocycloid curve 317 by an amount corresponding to the complementary line 314 interposing in the tooth tip 312.

As explained above, in the case of the external teeth 311 of the inner rotor 310, the circumferential thickness of the tooth tip 312 is made to be greater and the circumferential width of the tooth space 313 is reduced when compared with the case in which tooth profiles are formed just using the epicycloid curve 316 and the hypocycloid curve 317 that are generated by the circumscribed-rolling circle Ai and the inscribed-rolling circle Bi, respectively.

The distance "$\alpha_3$" between the outer tooth curve segment 312*a* and the outer tooth curve segment 312*b* is set so as to satisfy the following inequality: $t_3/4 \leqq \alpha_3$, and more preferably, the distance "$\alpha_3$" is set so as to satisfy the following inequality: $2t_3/5 \leqq \alpha_3$. As a result, the clearance between the tooth surfaces with respect to the outer rotor 320 are appropriately ensured, and quietness can be sufficiently improved.

Moreover, the distance "$\alpha_3$" between the outer tooth curve segment 312*a* and the outer tooth curve segment 312*b* is set so as to satisfy the following inequality: $\alpha_3 \leqq 3t_3/4$, and more preferably, the distance "$\alpha_3$" is set so as to satisfy the following inequality: $\alpha_3 \leqq 3t_3/5$. As a result, the clearance with respect to the outer rotor 320 is prevented from being too small, and locking in rotation, increase in wear, and reduction in service life of the oil pump rotor assembly can be prevented.

Next, the detailed profile of each of the internal teeth 321 of the outer rotor 320 will be explained with reference to FIGS. 9A to 9D. The internal teeth 321 of the outer rotor 320 are formed by alternately arranging tooth tips 322 and tooth spaces 323 in the circumferential direction.

In order to form the profile of the tooth tip 322, first, the hypocycloid curve 326 (FIG. 9A) generated by the inscribed-rolling circle Bo is equally divided at a midpoint $C_3$ thereof into two segments that are designated by inner tooth curve segments 322*a* and 322*b*, respectively.

Figure 9A:
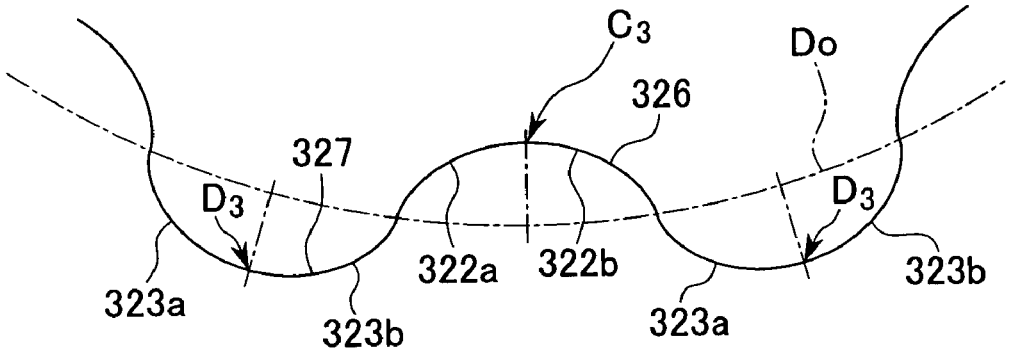
FIGS. 9A to 9D are enlarged views showing the tooth profiles of an outer rotor of the oil pump rotor assembly shown in FIG. 7.
Figure 9B:
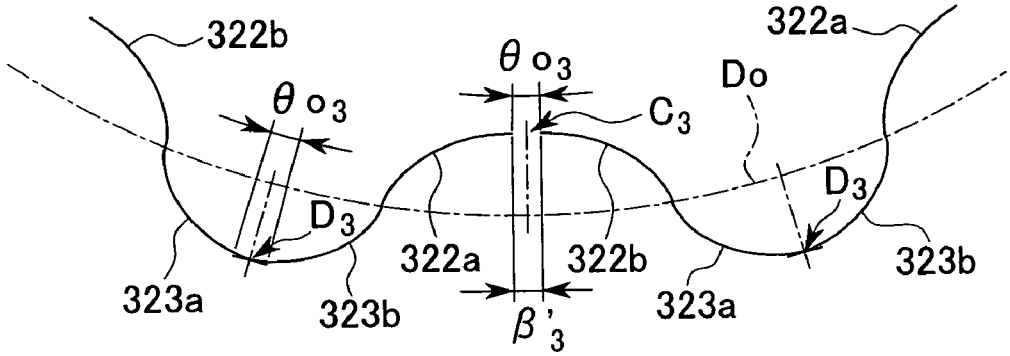

Next, as shown in FIG. 9B, the inner tooth curve segments 322*a* and 322*b* are moved along the circumference of the base circle Do by an amount of angle $\theta o_3$ so that a distance "$\beta'_3$" is ensured between the inner tooth curve segments 322*a* and 322*b*.

Figure 9C:
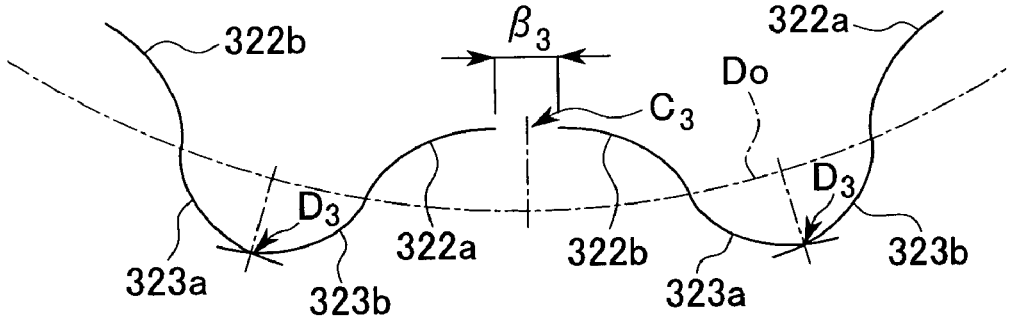

Moreover, as shown in FIG. 9C, the inner tooth curve segments 322*a* and 322*b* are moved in the direction of a tangent of the hypocycloid curve 317 drawn at the midpoint $C_3$ thereof so that a distance "$\beta_3$" is ensured between the outer tooth curve segments 312*a* and 312*b*.

Figure 9D:
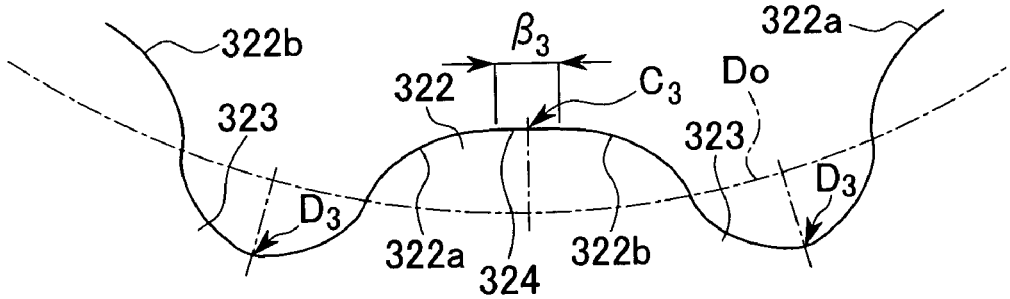

As shown in FIG. 9D, the separated ends of the inner tooth curve segments 322*a* and 322*b* are connected to each other by a complementary line 324 consisting of a straight line, and the obtained continuous curve is used as the profile of the tooth tip 322.

That is, the tooth tip 322 is formed using a continuous curve that includes the inner tooth curve segments 322*a* and 322*b*, which are separated from each other, and the complementary line 324 connecting the inner tooth curve segment 322*a* with the inner tooth curve segment 322*b*.

As a result, the circumferential thickness of the tooth tip 322 is greater than a tooth tip which is formed just using the simple hypocycloid curve 326 by an amount corresponding to the interposing complementary line 324. In this embodiment, the complementary line 324, which connects the inner tooth curve segment 322*a* with the inner tooth curve segment 322*b*, is a straight line; however, the complementary line 324 may be a curve.

The circumferential thickness of the tooth tip 322 is made to be greater than that of a conventional tooth tip as explained above, and on the other hand, in this embodiment, the width of the tooth space 323 is decreased, and tooth profiles are smoothly connected to each other over the entirety of the circumference.

More specifically, in order to form the profile of the tooth space 323, first, the epicycloid curve 327 (FIG. 9A) generated by the circumscribed-rolling circle Ao is equally divided at a midpoint $D_3$ thereof into two segments that are designated by curve segments 323*a* and 323*b*, respectively.

Next, as shown in FIG. 9B, the curve segments 323*a* and 323*b* are moved along the circumference of the base circle Do so that the ends of the curve segments 323*a* and 323*b* are respectively connected to the ends of the continuous curve that forms the tooth tip 322. As a result, the curve segments 323*a* and 323*b* overlap each other while intersecting each other at the midpoint $D_3$.

Moreover, as shown in FIG. 9C, the curve segments 323*a* and 323*b* are moved in the direction of a tangent of the epicycloid curve 327 drawn at the midpoint $D_3$ thereof so that the ends of the curve segments 323*a* and 323*b* are respectively connected to the ends of the continuous curve that forms the tooth tip 312.

As shown in FIG. 9D, the curve segments 323*a* and 323*b* are smoothly connected to each other so as to form a continuous curve that defines the tooth profile of the tooth space 323.

As a result, the circumferential width of the tooth space 323 is less than that of a tooth space which is formed just using the simple epicycloid curve 327 by an amount corresponding to the complementary line 324 interposing in the tooth tip 322.

As explained above, in the case of the internal teeth 321 of the inner rotor 320, the circumferential thickness of the tooth tip 322 is made to be greater and the circumferential width of the tooth space 323 is reduced when compared with the case in which tooth profiles are formed just using the epicycloid curve 327 and the hypocycloid curve 326 that are generated by the circumscribed-rolling circle Ao and the inscribed-rolling circle Bo, respectively.

The distance "$\beta_3$" between the outer tooth curve segment 322*a* and the outer tooth curve segment 322*b* is set so as to satisfy the following inequality: $t_3/4 \leqq \beta_3$, and more preferably, the distance "$\beta_3$" is set so as to satisfy the following inequality: $2t_3/5 \leqq \beta_3$. As a result, the clearance between the tooth surfaces with respect to the inner rotor 310 are appropriately ensured, and quietness can be sufficiently improved.

Moreover, the distance "$\beta_3$" between the outer tooth curve segment 322*a* and the outer tooth curve segment 322*b* is set so as to satisfy the following inequality: $\beta_3 \leqq 3t_3/4$, and more preferably, the distance "$\beta_3$" is set so as to satisfy the following inequality: $\beta_3 \leqq 3t_3/5$. As a result, the clearance with respect to the inner rotor 310 is prevented from being too small, and locking in rotation, increase in wear, and reduction in service life of the oil pump rotor assembly can be prevented.

FIG. 7 shows the inner rotor 310 and the outer rotor 320 which are formed according to the following dimensions: øDi=52 mm, øAi=2.5 mm, øBi=2.7 mm, øDo=57.2 mm, øAo=2.56 mm, øBo=2.64 mm, e=2.6 mm, $t_3$=0.12 mm, $\alpha_3$ (the distance between the outer tooth curve segments 312*a* and 312*b*)=$\beta_3$ (the inner tooth curve segments 322*a* and 322*b*)=$t_3/2$ (=0.06 mm).

Because "$\alpha_3$" and "$\beta_3$", i.e., the amounts of movement of the tooth curve segments are too small to be shown in linear scale, they are greatly enlarged in FIGS. 8A to 8D, and in FIGS. 9A to 9D in order to explain the detailed profiles of the tooth surfaces; therefore, the tooth profiles shown in FIGS. 8A to 8D, and in FIGS. 9A to 9D are distorted when compared with the actual tooth profiles shown in FIG. 7.

In the above embodiment, the circumferential thicknesses of both tooth tip 312 of the inner rotor 310 and tooth tip 322 of the outer rotor 320 are increased when compared with conventional cases; however, the present invention is not limited to this, and other configurations may be employed in which one of the tooth tip 312 of the inner rotor 310 and tooth tip 322 of the outer rotor 320 is made thicker, and the tooth profile of the other tooth tip is formed using a cycloid curve without modification.

Moreover, as another embodiment derived from the above first embodiment, other curves may be employed as the base tooth curves to which the above-mentioned correction is applied, so that the following relationships are satisfied between the inner rotor 310 and the outer rotor 320.

With regard to the base curves that define tooth profiles of the inner rotor 310, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi \cdot øDi = n \cdot \pi \cdot (øAi + øBi), \text{ i.e.,}$$

$$øDi = n \cdot (øAi + øBi).$$

Similarly, with regard to the base curves that define tooth profiles of the outer rotor 320, because the length of circumference of the base circle Do of the outer rotor 320 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi \cdot øDo = (n+1) \cdot \pi \cdot (øAo + øBo), \text{ i.e.,}$$

$$øDo = (n+1) \cdot (øAo + øBo).$$

Next, in order to ensure an appropriate clearance between the center of the tooth space of the inner rotor 310 and the center of the tooth tip of the outer rotor 320, the following equation is satisfied between the inscribed-rolling circles Bi and Bo:

$$øBi = øBo,$$

and with regard to the base circle Do of the outer rotor 320, the following equation is satisfied:

$$øDo = øDi \cdot (n+1)/n + t_3 \cdot (n+1)/(n+2).$$

Moreover, with regard to the circumscribed-rolling circle Ao, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øAo=øAi+t_3/(n+2).$$

The oil pump rotor assembly of the present invention may be formed using the base curves that satisfy the above relationships.

Furthermore, as another embodiment derived from the above first embodiment, other curves may be employed as the base tooth curves to which the above-mentioned correction is applied, so that the following relationships are satisfied between the inner rotor 310 and the outer rotor 320.

With regard to the base curves that define tooth profiles of the inner rotor 310, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi\cdot øDi=n\cdot\pi\cdot(øAi+øBi), \text{ i.e.,}$$

$$øDi=n\cdot(øAi+øBi).$$

Similarly, with regard to the base curves that define tooth profiles of the outer rotor 320, because the length of circumference of the base circle Do of the outer rotor 320 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi\cdot øDo=(n+1)\cdot\pi\cdot(øAo+øBo), \text{ i.e.,}$$

$$øDo=(n+1)\cdot(øAo+øBo).$$

Next, in order to ensure an appropriate clearance between the center of the tooth tip of the inner rotor 310 and the center of the tooth space of the outer rotor 320, the following equation is satisfied between the circumscribed-rolling circles Ai and Ao:

$$øAi=øAo,$$

and with regard to the base circle Do of the outer rotor 320, the following equation is satisfied:

$$øDo=øDi\cdot(n+1)/n+t_3\cdot(n+1)/(n+2).$$

Moreover, with regard to the inscribed-rolling circle Bo, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øBo=øBi+t_3/(n+2).$$

The oil pump rotor assembly of the present invention may be formed using the base curves that satisfy the above relationships.

Fourth Embodiment

A fourth embodiment of an oil pump rotor assembly according to the present invention will be explained below with reference to FIGS. 10 to 12D.

Figure 10:
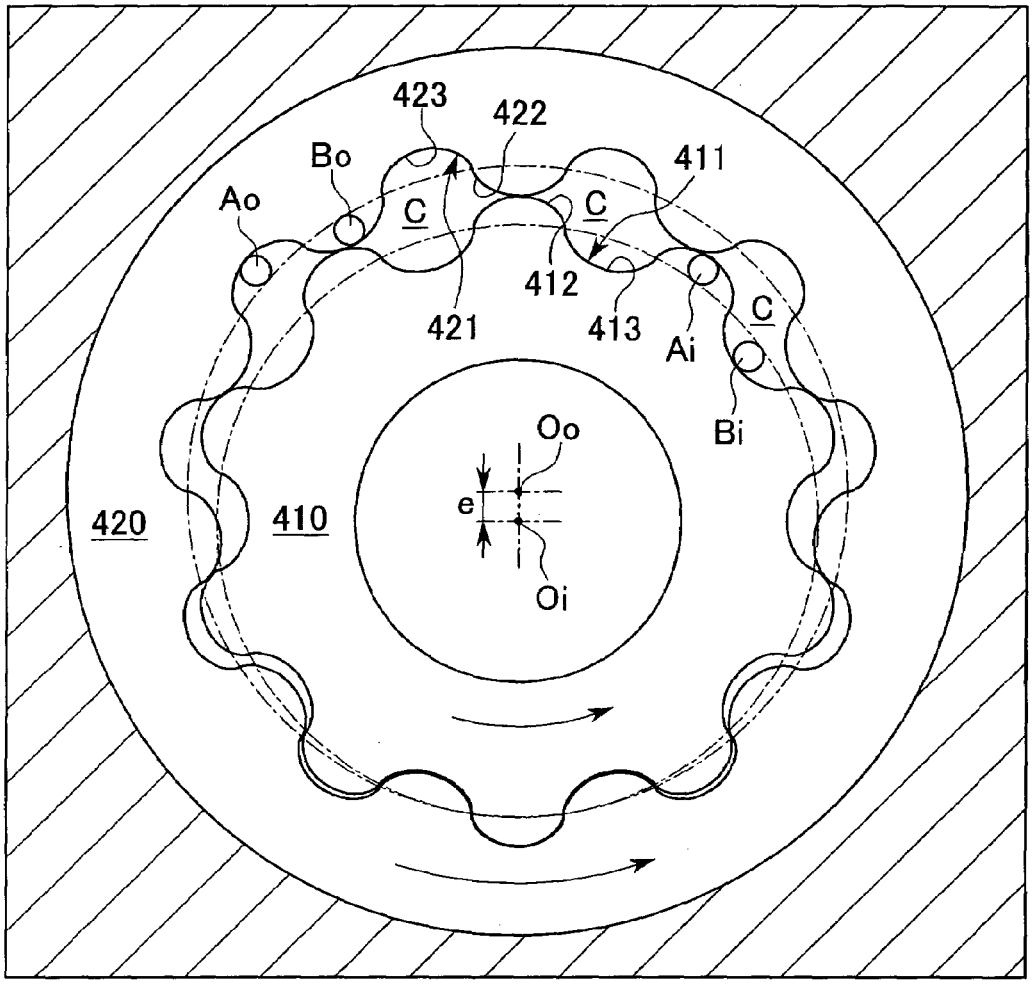
FIG. 10 is a diagram showing a fourth embodiment of an oil pump rotor assembly according to the present invention.

The oil pump shown in FIG. 10 comprises an inner rotor 410 provided with "n" external teeth 411 ("n" indicates a natural number, and n=10 in this embodiment), an outer rotor 420 provided with "n+1" internal teeth 421 ($n$+1=11 in this embodiment) which are engageable with the external teeth 411, and a casing 30 which accommodates the inner rotor 410 and the outer rotor 420.

Between the tooth surfaces of the inner rotor 410 and outer rotor 420, there are formed plural cells C in the direction of rotation of the inner rotor 410 and outer rotor 420. Each of the cells C is delimited at a front portion and at a rear portion as viewed in the direction of rotation of the inner rotor 410 and outer rotor 420 by contact regions between the external teeth 411 of the inner rotor 410 and the internal teeth 421 of the outer rotor 420, and is also delimited at either side portions by the casing 30, so that an independent fluid conveying chamber is formed. Each of the cells C moves while the inner rotor 410 and outer rotor 420 rotate, and the volume of each of the cells C cyclically increases and decreases so as to complete one cycle in a rotation.

In the casing 30, there are formed a suction port, which communicates with one of the cells C whose volume increases gradually, and a discharge port, which communicates with one of the cells C whose volume decreases gradually, and fluid drawn into one of the cells C through the suction port is transported as the rotors 410 and 420 rotate, and is discharged through the discharge port.

A clearance that is formed between the apex of the tooth tip 412 of the inner rotor 410 and the apex of the tooth tip 422 of the outer rotor 420, which face each other on a line passing through the centers Oi and Oo of the rotors, is designated by a tip clearance. The size "$t_4$" of this tip clearance is defined as the size of a tip clearance that is formed in a state in which the rotors 410 and 420 are disposed such that clearance between the tooth tip 412 of the inner rotor 410 and the tooth space 423 of the outer rotor 420, which engage each other on the line passing through the centers Oi and Oo at a diametrically opposing position, is zero.

When the rotors are driven, the center Oi of the inner rotor 410 and the center Oo of the outer rotor 420 are disposed to have an eccentric distance therebetween so that the same clearance $t_4/2$ is formed between the tooth surfaces at two positions, located on the line passing through the centers Oi and Oo, at which the tooth surfaces face each other. The eccentric distance between the centers Oi and Oo is designated by "e".

The inner rotor 410 is mounted on a rotational axis so as to be rotatable about the center Oi, and the tooth profile of each of the external teeth 411 of the inner rotor 410 is formed using an epicycloid curve 416, which is generated by rolling a circumscribed-rolling circle Ai (whose diameter is øAi) along the base circle Di (whose diameter is øDi) of the inner rotor 410 without slip, and using a hypocycloid curve 417, which is generated by rolling an inscribed-rolling circle Bi (whose diameter is øBi) along the base circle Di without slip.

The outer rotor 420 is mounted so as to be rotatable about the center Oo, and the center thereof is positioned so as to have an offset (the eccentric distance is "e") from the center Oi. The tooth profile of each of the internal teeth 421 of the outer rotor 420 is formed using an epicycloid curve 427, which is generated by rolling a circumscribed-rolling circle Ao (whose diameter is øAo) along the base circle Do (whose diameter is øDo) of the outer rotor 420 without slip, and using a hypocycloid curve 426, which is generated by rolling an inscribed-rolling circle Bo (whose diameter is øBo) along the base circle Do without slip.

The equations which will be discussed below are to be satisfied between the inner rotor 410 and the outer rotor 420. Note that dimensions will be expressed in millimeters.

With regard to the base curves that define tooth profiles of the inner rotor 410, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi\cdot øDi=n\cdot\pi\cdot(øAi+øBi), \text{ i.e.,}$$

$$øDi=n\cdot(øAi+øBi) \quad \text{(I).}$$

Similarly, with regard to the base curves that define tooth profiles of the outer rotor 420, because the length of circumference of the base circle Do of the outer rotor 420 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi\cdot øDo=(n+1)\cdot\pi\cdot(øAo+øBo), \text{ i.e.,}$$

$$øDo=(n+1)\cdot(øAo+øBo) \quad \text{(II).}$$

Next, since the inner rotor 410 engages the outer rotor 420, $$øAi+øBi=øAo+øBo=2e \quad \text{(III).}$$

Based on the above equations (I), (II), and (III), $$(n+1)\cdot øDi=n\cdot øDo \quad \text{(IV).}$$

Moreover, with regard to the tip clearance which is formed between the apex of the tooth tip 412 of the external tooth 411 and the apex of the tooth tip 422 of the internal tooth 421 in a rotational phase advancing by 180° from a rotational phase in which the apexes face each other, the following equations are satisfied:

$$øAi+t_4/2=øAo \quad \text{(V); and}$$

$$øBi-t_4/2=øBo \quad \text{(VI).}$$

The detailed profile of each of the external teeth 411 of the inner rotor 410 will be explained with reference to FIGS. 11A to 11D. The external teeth 411 of the inner rotor 410 are formed by alternately arranging tooth tips 412 and tooth spaces 413 in the circumferential direction.

In order to form the profile of the tooth tip 412, first, the epicycloid curve 416 (FIG. 11A) generated by the circumscribed-rolling circle Ai is equally divided at a midpoint $A_4$ thereof into two segments that are designated by outer tooth curve segments 412*a* and 412*b*, respectively.

Figure 11A:
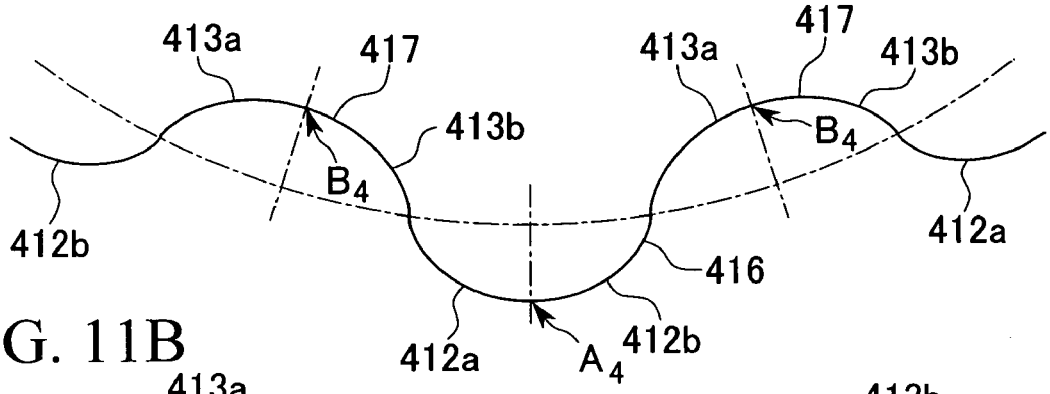
FIGS. 11A to 11D are enlarged views showing the tooth profiles of an inner rotor of the oil pump rotor assembly shown in FIG. 10.
Figure 11B:
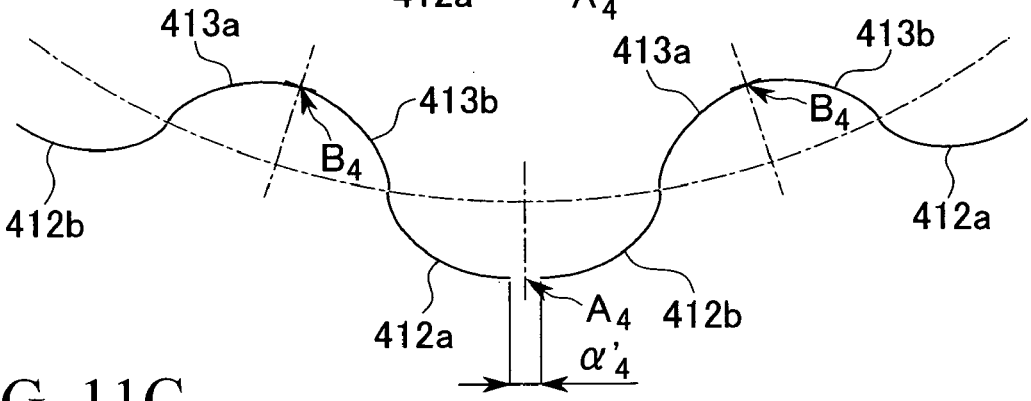

Next, as shown in FIG. 11B, the outer tooth curve segments 412*a* and 412*b* are moved in the direction of a tangent of the epicycloid curve 416 drawn at the midpoint $A_4$ thereof so that a distance "$\alpha'_4$" is ensured between the outer tooth curve segments 412*a* and 412*b*.

Figure 11C:
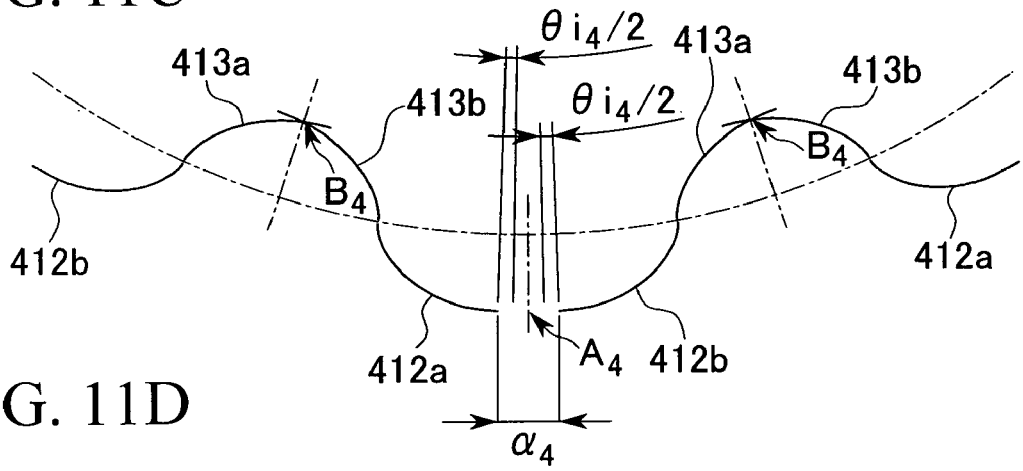

Moreover, as shown in FIG. 11C, the outer tooth curve segments 412*a* and 412*b* are moved along the circumference of the base circle Di by an amount of angle $\theta i_4/2$ so that a distance "$\alpha_4$" is ensured between the outer tooth curve segments 412*a* and 412*b*.

Figure 11D:
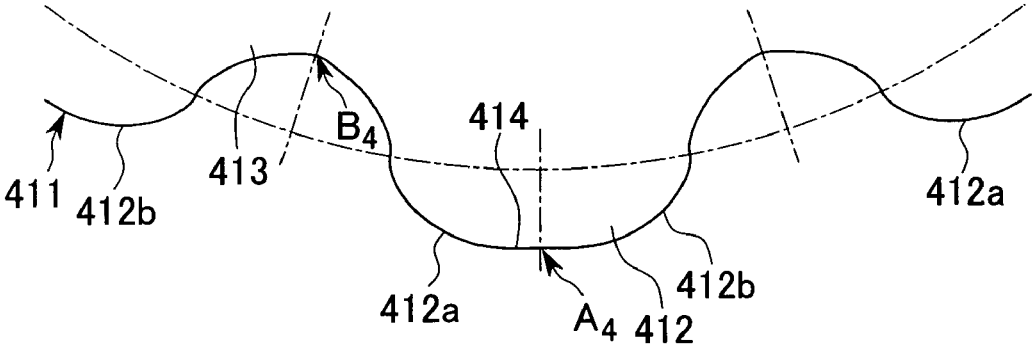

As shown in FIG. 11D, the separated ends of the outer tooth curve segments 412*a* and 412*b* are connected to each other by a complementary line 414 consisting of a straight line, and the obtained continuous curve is used as the profile of the tooth tip 412.

That is, the tooth tip 412 is formed using a continuous curve that includes the outer tooth curve segments 412*a* and 412*b*, which are separated from each other, and the complementary line 414 connecting the outer tooth curve segment 412*a* with the outer tooth curve segment 412*b*.

As a result, the circumferential thickness of the tooth tip 412 of the inner rotor 410 is greater than a tooth tip which is formed just using the simple epicycloid curve 416 by an amount corresponding to the interposing complementary line 414. In this embodiment, the complementary line 414, which connects the outer tooth curve segment 412*a* with the outer tooth curve segment 412*b*, is a straight line; however, the complementary line 414 may be a curve.

The circumferential thickness of the tooth tip 412 is made to be greater than that of a conventional tooth tip as explained above, and on the other hand, in this embodiment, the width of the tooth space 413 is decreased, and tooth profiles are smoothly connected to each other over the entirety of the circumference.

More specifically, in order to form the profile of the tooth space 413, first, the hypocycloid curve 417 (FIG. 11A) generated by the inscribed-rolling circle Bi is equally divided at a midpoint $B_4$ thereof into two segments that are designated by curve segments 413*a* and 413*b*, respectively.

Next, as shown in FIG. 11B, the curve segments 413*a* and 413*b* are moved in the direction of a tangent of the hypocycloid curve 417 drawn at the midpoint $B_4$ thereof so that the ends of the curve segments 413*a* and 413*b* are respectively connected to the ends of the continuous curve that forms the tooth tip 412. As a result, the curve segments 413*a* and 413*b* overlap each other while intersecting each other at the midpoint $B_4$.

Moreover, as shown in FIG. 11C, the curve segments 413*a* and 413*b* are moved along the circumference of the base circle Di so that the ends of the curve segments 413*a* and 413*b* are respectively connected to the ends of the continuous curve that forms the tooth tip 412.

As shown in FIG. 11D, the curve segments 413*a* and 413*b* are smoothly connected to each other so as to form a continuous curve that defines the tooth profile of the tooth space 413.

As a result, the circumferential width of the tooth space 413 is less than that of a tooth space which is formed just using the simple hypocycloid curve 417 by an amount corresponding to the complementary line 414 interposing in the tooth tip 412.

As explained above, in the case of the external teeth 411 of the inner rotor 410, the circumferential thickness of the tooth tip 412 is made to be greater and the circumferential width of the tooth space 413 is reduced when compared with the case in which tooth profiles are formed just using the epicycloid curve 416 and the hypocycloid curve 417 that are generated by the circumscribed-rolling circle Ai and the inscribed-rolling circle Bi, respectively.

The distance "$\alpha_4$" between the outer tooth curve segment 412*a* and the outer tooth curve segment 412*b* is set so as to satisfy the following inequality: $t_4/4 \leqq \alpha_4$, and more preferably, the distance "$\alpha_4$" is set so as to satisfy the following inequality: $2t_4/5 \leqq \alpha_4$. As a result, the clearance between the tooth surfaces with respect to the outer rotor 420 are appropriately ensured, and quietness can be sufficiently improved.

Moreover, the distance "$\alpha_4$" between the outer tooth curve segment 412*a* and the outer tooth curve segment 412*b* is set so as to satisfy the following inequality: $\alpha_4 \leqq 3t_4/4$, and more preferably, the distance "$\alpha_4$" is set so as to satisfy the following inequality: $\alpha_4 \leqq 3t_4/5$. As a result, the clearance with respect to the outer rotor 420 is prevented from being too small, and locking in rotation, increase in wear, and reduction in service life of the oil pump rotor assembly can be prevented.

Next, the detailed profile of each of the internal teeth 421 of the outer rotor 420 will be explained with reference to FIGS. 12A to 12D. The internal teeth 421 of the outer rotor 420 are formed by alternately arranging tooth tips 422 and tooth spaces 423 in the circumferential direction.

In order to form the profile of the tooth tip 422, first, the hypocycloid curve 426 (FIG. 12A) generated by the inscribed-rolling circle Bo is equally divided at a midpoint $C_4$ thereof into two segments that are designated by inner tooth curve segments 422*a* and 422*b*, respectively.

Figure 12A:
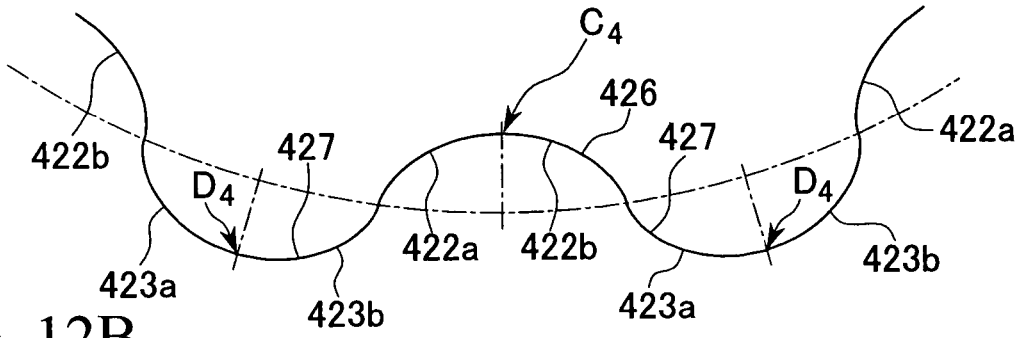
FIGS. 12A to 12D are enlarged views showing the tooth profiles of an outer rotor of the oil pump rotor assembly shown in FIG. 10.
Figure 12B:
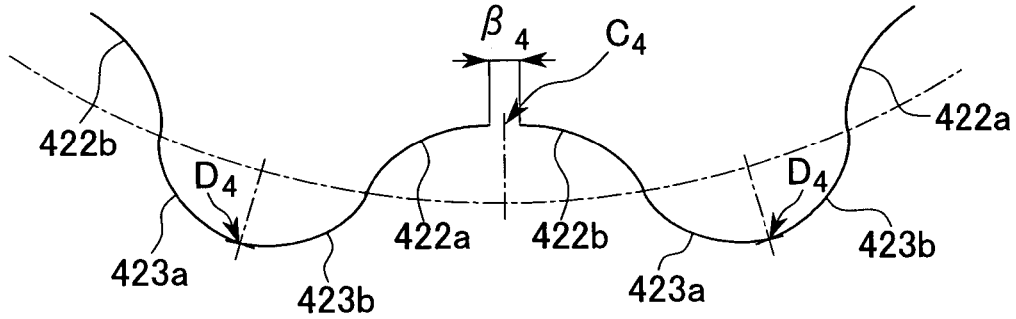

Next, as shown in FIG. 12B, the inner tooth curve segments 422*a* and 422*b* are moved in the direction of a tangent of the hypocycloid curve 426 drawn at the midpoint $C_4$ thereof so that a distance "$\beta'_4$" is ensured between the outer tooth curve segments 412*a* and 412*b*.

Figure 12C:
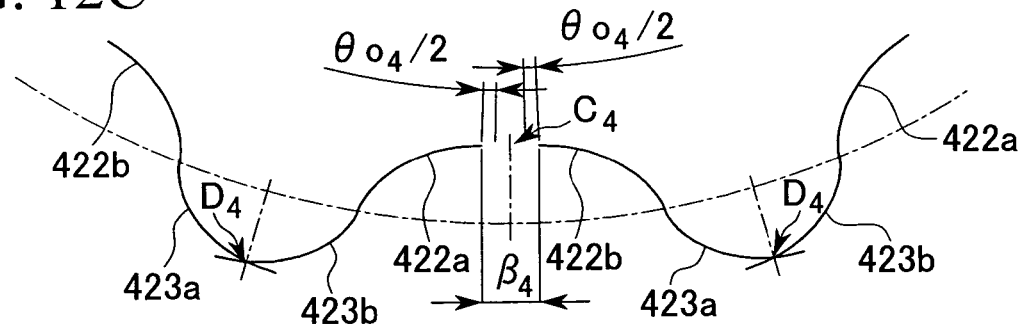

Moreover, as shown in FIG. 12C, the inner tooth curve segments 422*a* and 422*b* are moved along the circumference of the base circle Do by an amount of angle $\theta o_4/2$ so that a distance "$\beta_4$" is ensured between the inner tooth curve segments 422*a* and 422*b*.

Figure 12D:
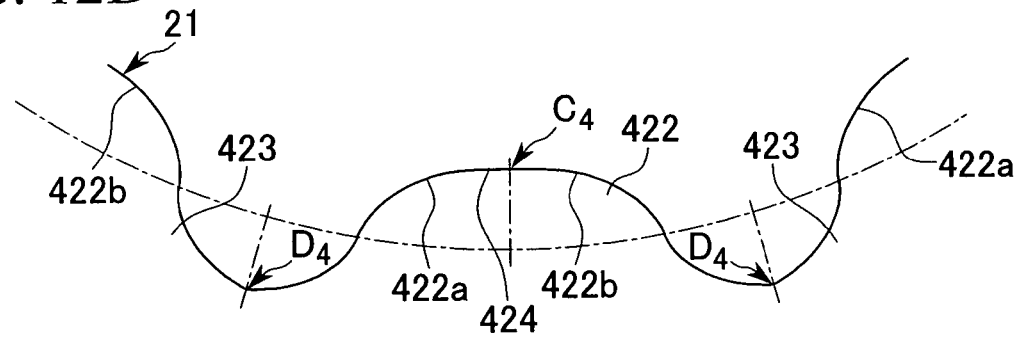

As shown in FIG. 12D, the separated ends of the inner tooth curve segments 422*a* and 422*b* are connected to each other by a complementary line 424 consisting of a straight line, and the obtained continuous curve is used as the profile of the tooth tip 422.

That is, the tooth tip 422 is formed using a continuous curve that includes the inner tooth curve segments 422*a* and 422*b*, which are separated from each other, and the complementary line 424 connecting the inner tooth curve segment 422*a* with the inner tooth curve segment 422*b*.

As a result, the circumferential thickness of the tooth tip 422 is greater than a tooth tip which is formed just using the simple hypocycloid curve 426 by an amount corresponding to the interposing complementary line 424. In this embodiment, the complementary line 424, which connects the inner tooth curve segment 422*a* with the inner tooth curve segment 422*b*, is a straight line; however, the complementary line 424 may be a curve.

The circumferential thickness of the tooth tip 422 is made to be greater than that of a conventional tooth tip as explained above, and on the other hand, in this embodiment, the width of the tooth space 423 is decreased, and tooth profiles are smoothly connected to each other over the entirety of the circumference.

More specifically, in order to form the profile of the tooth space 423, first, the epicycloid curve 427 (FIG. 12A) generated by the circumscribed-rolling circle Ao is equally divided at a midpoint $D_4$ thereof into two segments that are designated by curve segments 423*a* and 423*b*, respectively.

Next, as shown in FIG. 12B, the curve segments 423*a* and 423*b* are moved in the direction of a tangent of the epicycloid curve 427 drawn at the midpoint $D_4$ thereof so that the ends of the curve segments 423*a* and 423*b* are respectively connected to the ends of the continuous curve that forms the tooth tip 412, and so that the curve segments 423*a* and 423*b* overlap each other while intersecting each other at the midpoint $D_4$.

Moreover, as shown in FIG. 12C, the curve segments 423*a* and 423*b* are moved along the circumference of the base circle Do so that the ends of the curve segments 423*a* and 423*b* are respectively connected to the ends of the continuous curve that forms the tooth tip 422.

As shown in FIG. 12D, the curve segments 423*a* and 423*b* are smoothly connected to each other so as to form a continuous curve that defines the tooth profile of the tooth space 423.

As a result, the circumferential width of the tooth space 423 is less than that of a tooth space which is formed just using the simple epicycloid curve 427 by an amount corresponding to the complementary line 424 interposing in the tooth tip 422.

As explained above, in the case of the internal teeth 421 of the inner rotor 420, the circumferential thickness of the tooth tip 422 is made to be greater and the circumferential width of the tooth space 423 is reduced when compared with the case in which tooth profiles are formed just using the epicycloid curve 427 and the hypocycloid curve 426 that are generated by the circumscribed-rolling circle Ao and the inscribed-rolling circle Bo, respectively.

The distance "$\beta_4$" between the outer tooth curve segment 422*a* and the outer tooth curve segment 422*b* is set so as to satisfy the following inequality: $t_4/4 \leqq \beta_4$, and more preferably, the distance "$\beta_4$" is set so as to satisfy the following inequality: $2t_4/5 \leqq \beta_4$. As a result, the clearance between the tooth surfaces with respect to the inner rotor 410 are appropriately ensured, and quietness can be sufficiently improved.

Moreover, the distance "$\beta_4$" between the outer tooth curve segment 422*a* and the outer tooth curve segment 422*b* is set so as to satisfy the following inequality: $\beta_4 \leqq 3t_4/4$, and more preferably, the distance "$\beta_4$" is set so as to satisfy the following inequality: $\beta_4 \leqq 3t_4/5$. As a result, the clearance with respect to the inner rotor 410 is prevented from being too small, and locking in rotation, increase in wear, and reduction in service life of the oil pump rotor assembly can be prevented.

FIG. 10 shows the inner rotor 410 and the outer rotor 420 which are formed according to the following dimensions: øDi=52 mm, øAi=2.5 mm, øBi=2.7 mm, øDo=57.2 mm, øAo=2.56 mm, øBo=2.64 mm, e=2.6 mm, $t_4$=0.12 mm, $\alpha_4$ (the distance between the outer tooth curve segments 412*a* and 412*b*)=$\beta_4$ (the inner tooth curve segments 422*a* and 422*b*)=$t_4/2$ (=0.06 mm).

Because "$\alpha_4$" and "$\beta_4$", i.e., the amounts of movement of the tooth curve segments are too small to be shown in linear scale, they are greatly enlarged in FIGS. 11A to 11D, and in FIGS. 12A to 12D in order to explain the detailed profiles of the tooth surfaces; therefore, the tooth profiles shown in FIGS. 11A to 11D, and in FIGS. 12A to 12D are distorted when compared with the actual tooth profiles shown in FIG. 10.

In the above embodiment, the circumferential thicknesses of both tooth tip 412 of the inner rotor 410 and tooth tip 422 of the outer rotor 420 are increased when compared with conventional cases; however, the present invention is not limited to this, and other configurations may be employed in which one of the tooth tip 412 of the inner rotor 410 and tooth tip 422 of the outer rotor 420 is made thicker, and the tooth profile of the other tooth tip is formed using a cycloid curve without modification.

Moreover, as another embodiment derived from the above first embodiment, other curves may be employed as the base tooth curves to which the above-mentioned correction is applied, so that the following relationships are satisfied between the inner rotor 410 and the outer rotor 420.

With regard to the base curves that define tooth profiles of the inner rotor 410, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi \cdot øDi = n \cdot \pi \cdot (øAi + øBi), \text{ i.e.,}$$

$$øDi=n\cdot(øAi+øBi).$$

Similarly, with regard to the base curves that define tooth profiles of the outer rotor 420, because the length of circumference of the base circle Do of the outer rotor 420 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi\cdot øDo=(n+1)\cdot\pi\cdot(øAo+øBo), \text{ i.e.,}$$

$$øDo=(n+1)\cdot(øAo+øBo).$$

Next, in order to ensure an appropriate clearance between the center of the tooth space of the inner rotor 410 and the center of the tooth tip of the outer rotor 420, the following equation is satisfied between the inscribed-rolling circles Bi and Bo:

$$øBi=øBo,$$

and with regard to the base circle Do of the outer rotor 420, the following equation is satisfied:

$$øDo=øDi\cdot(n+1)/n+t_4\cdot(n+1)/(n+2).$$

Moreover, with regard to the circumscribed-rolling circle Ao, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øAo=øAi+t_4/(n+2).$$

The oil pump rotor assembly of the present invention may be formed using the base curves that satisfy the above relationships.

Furthermore, as another embodiment derived from the above first embodiment, other curves may be employed as the base tooth curves to which the above-mentioned correction is applied, so that the following relationships are satisfied between the inner rotor 410 and the outer rotor 420.

With regard to the base curves that define tooth profiles of the inner rotor 410, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth), $$\pi\cdot øDi=n\cdot\pi\cdot(øAi+øBi), \text{ i.e.,}$$

$$øDi=n\cdot(øAi+øBi).$$

Similarly, with regard to the base curves that define tooth profiles of the outer rotor 420, because the length of circumference of the base circle Do of the outer rotor 420 must be equal to the length obtained by multiplying the sum of the rolling distance per revolution of the circumscribed-rolling circle Ao and the rolling distance of the inscribed-rolling circle Bo by an integer (i.e., by the number of teeth), $$\pi\cdot øDo=(n+1)\cdot\pi\cdot(øAo+øBo), \text{ i.e.,}$$

$$øDo=(n+1)\cdot(øAo+øBo).$$

Next, in order to ensure an appropriate clearance between the center of the tooth tip of the inner rotor 410 and the center of the tooth space of the outer rotor 420, the following equation is satisfied between the circumscribed-rolling circles Ai and Ao:

$$øAi=øAo,$$

and with regard to the base circle Do of the outer rotor 420, the following equation is satisfied:

$$øDo=øDi\cdot(n+1)/n+t_4\cdot(n+1)/(n+2).$$

Moreover, with regard to the inscribed-rolling circle Bo, because the length of circumference of the base circle Do must be equal to the length obtained by multiplying the sum of the rolling distance per revolution of the circumscribed-rolling circle Ao and the rolling distance of the inscribed-rolling circle Bo by an integer (i.e., by the number of teeth), $$øBo=øBi+t_4/(n+2).$$

The oil pump rotor assembly of the present invention may be formed using the base curves that satisfy the above relationships.

As explained above, according to the oil pump rotor assembly of the present invention, because at least one of the tooth profile of the inner rotor and the tooth profile of the outer rotor is formed such that the circumferential thickness of the tooth tip is slightly greater than that of a conventional oil pump rotor assembly by equally dividing a cycloid curve for defining the tooth profile into two at a midpoint thereof to obtain two tooth curve segments, and by moving the two tooth curve segments along the circumference of the base circle or by moving in the direction of a tangent of the cycloid curve drawn at the midpoint thereof based on an oil pump rotor assembly in which an appropriate tip clearance is ensured, the circumferential thickness of the tooth tip is made to be greater than that in the case of a conventional oil pump rotor assembly without changing the position of the tooth tip apex; therefore, an oil pump rotor assembly, which emits less noise, and which exhibits better mechanical performance when compared with a conventional oil pump rotor assembly, can be obtained.

Specifically, by setting the distance "α" between the outer tooth curve segments and the distance "β" between the inner tooth curve segments to be equal to or greater than a quarter of the tip clearance, the clearance between the surfaces of the teeth of the inner and outer rotors may be made small; therefore, impacts between the rotors and hydraulic pulsation due to a large clearance between the tooth surfaces may be prevented, and an oil pump rotor assembly, which emits less noise, and which exhibits better mechanical performance when compared with a conventional oil pump rotor assembly, can be obtained.

Furthermore, by setting the distance "α" between the outer tooth curve segments and the distance "β" between the inner tooth curve segments to be equal to or less than three quarters of the tip clearance, an appropriate clearance between the surfaces of the teeth of the inner and outer rotors may be ensured; therefore, an oil pump rotor assembly, which rotates smoothly, and which has sufficient service life, can be obtained.

What is claimed is:

1. An oil pump rotor assembly comprising:

an inner rotor having "n" external teeth ("n" is a natural number);

an outer rotor having (n+1) internal teeth which are engageable with the external teeth; and the distance between an apex of an outer tooth of the inner rotor and an apex of an inner tooth of the outer rotor when the apexes oppose each other defining a tip clearance therebetween, wherein the oil pump rotor assembly is used in an oil pump which further includes a casing having a suction port for drawing fluid and a discharge port for discharging fluid, and which conveys fluid by drawing and discharging fluid by volume change of cells formed between tooth surfaces of the inner rotor and the outer rotor during relative rotation between the inner rotor and the outer rotor engaging each other, wherein each of the tooth profiles of the outer rotor is formed such that the tooth space profile thereof is formed using an epicycloid curve which is generated by rolling a circumscribed-rolling circle Ao along a base circle Do without slip, and the tooth tip profile thereof is formed using a hypocycloid curve which is generated by rolling an inscribed-rolling circle Bo along the base circle Do without slip, wherein the tooth space profile of the inner rotor is formed based on a hypocycloid curve which is formed by rolling an inscribed-rolling circle Bi along a base circle Di without slip, wherein the tooth tip profile of the inner rotor is formed such that an epicycloid curve, which is generated by rolling a circumscribed-rolling circle Ai along the base circle Di without slip, is equally divided into two at a midpoint thereof to obtain two outer tooth curve segments, and the two outer tooth curve segments are separated by a predetermined distance and are smoothly connected to each other using a curve or a straight line, and wherein the predetermined distance between the two outer tooth curve segments is designated by "α", and the tip clearance is designated by "t", "α" is set so as to satisfy the following inequalities:

$$t/4 \leqq \alpha \leqq 3t/4.$$

2. An oil pump rotor assembly according to claim 1, wherein the separation of the two outer tooth curve segments is performed in such a manner that the two outer tooth curve segments are moved along the circumference of the base circle Di.

3. An oil pump rotor assembly according to claim 1, wherein the separation of the two outer tooth curve segments is performed in such a manner that the two outer tooth curve segments are moved in the direction of a tangent of the epicycloid curve drawn at the midpoint thereof.

4. An oil pump rotor assembly according to claim 1, wherein the separation of the two outer tooth curve segments is performed in such a manner that the two outer tooth curve segments are first moved along the circumference of the base circle Di, and then moved in the direction of a tangent of the epicycloid curve drawn at the midpoint thereof.

5. An oil pump rotor assembly according to claim 1, wherein the separation of the two outer tooth curve segments is performed in such a manner that the two outer tooth curve segments are first moved in the direction of a tangent of the epicycloid curve drawn at the midpoint thereof, and then moved along the circumference of the base circle Di.

6. An oil pump rotor assembly according to claim 1, wherein the predetermined distance "60 " is set so as to satisfy the following inequalities:

$$2t/5 \leqq \alpha \leqq 3t/5.$$

7. An oil pump rotor assembly according to claim 1, wherein the inner rotor and the outer rotor are formed such that the following equations are satisfied:

$$øAi+t/2=øAo;$$

$$øBi-t/2=øBo;$$

$$øAi+øBi=øAo+øBo=2e;$$

$$øDi=n\cdot(øAi+øBi);$$

$$øDo=(n+1)\cdot(øAo+øBo); \text{ and}$$

$$(n+1)\cdot øDi=n\cdot øDo,$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

8. An oil pump rotor assembly according to claim 1, wherein the inner rotor and the outer rotor are formed such that the following equations are satisfied:

$$øAi+t/(n+2)=øAo;$$

$$øBi=øBo;$$

$$øAi+øBi=2e;$$

$$øDi=n\cdot(øAi+øBi); \text{ and}$$

$$øDo=øDi\cdot(n+1)/n+t\cdot(n+1)/(n+2),$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

9. An oil pump rotor assembly according to claim 1, wherein the inner rotor and the outer rotor are formed such that the following equations are satisfied:

$$øAi=øAo;$$

$$øBi+t/(n+2)=øBo;$$

$$øAi+øBi=2e;$$

$$øDi=n\cdot(øAi+øBi); \text{ and}$$

$$øDo=øDi\cdot(n+1)/n+t\cdot(n+1)/(n+2),$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

10. An oil pump rotor assembly comprising:

an inner rotor having "n" external teeth ("n" is a natural number);

an outer rotor having (n+1) internal teeth which are engageable with the external teeth; and the distance between an apex of an outer tooth of the inner rotor and an apex of an inner tooth of the outer rotor when the apexes oppose each other defining a tip clearance therebetween, wherein the oil pump rotor assembly is used in an oil pump which further includes a casing having a suction port for drawing fluid and a discharge port for discharging fluid, and which conveys fluid by drawing and discharging fluid by volume change of cells formed between tooth surfaces of the inner rotor and the outer rotor during relative rotation between the inner rotor and the outer rotor engaging each other, wherein each of the tooth profiles of the inner rotor is formed such that the tooth tip profile thereof is formed using an epicycloid curve which is generated by rolling a circumscribed-rolling circle Ai along a base circle Di without slip, and the tooth space profile thereof is formed using a hypocycloid curve which is generated by rolling an inscribed-rolling circle Bi along the base circle Di without slip, wherein the tooth space profile of the outer rotor is formed based on an epicycloid curve which is formed by rolling a circumscribed-rolling circle Ao along a base circle Do without slip, wherein the tooth tip profile of the outer rotor is formed such that a hypocycloid curve, which is generated by rolling an inscribed-rolling circle Bo along the base circle Do without slip, is equally divided into two at a midpoint thereof to obtain two inner tooth curve segments, and the two inner tooth curve segments are separated by a predetermined distance and are smoothly connected to each other using a curve or a straight line, and wherein the predetermined distance between the two inner tooth curve segments is designated by "β", and the tip clearance is designated by "t", "β" is set so as to satisfy the following inequalities:

$$t/4 \leqq \beta \leqq 3t/4.$$

11. An oil pump rotor assembly according to claim 10, wherein the separation of the two inner tooth curve segments is performed in such a manner that the two inner tooth curve segments are moved along the circumference of the base circle Do.

12. An oil pump rotor assembly according to claim 10, wherein the separation of the two inner tooth curve segments is performed in such a manner that the two inner tooth curve segments are moved in the direction of a tangent of the hypocycloid curve drawn at the midpoint thereof.

13. An oil pump rotor assembly according to claim 10, wherein the separation of the two inner tooth curve segments is performed in such a manner that the two inner tooth curve segments are first moved along the circumference of the base circle Do, and then moved in the direction of a tangent of the hypocycloid curve drawn at the midpoint thereof.

14. An oil pump rotor assembly according to claim 10, wherein the separation of the two inner tooth curve segments is performed in such a manner that the two inner tooth curve segments are first moved in the direction of a tangent of the hypocycloid curve drawn at the midpoint thereof, and then moved along the circumference of the base circle Do.

15. An oil pump rotor assembly according to claim 8, wherein the predetermined distance "β" is set so as to satisfy the following inequalities:

$$2t/5 \leqq \alpha \leqq 3t/5.$$

16. An oil pump rotor assembly according to claim 8, wherein the inner rotor and the outer rotor are formed such that the following equations are satisfied:

$$øAi+t/2=øAo;$$

$$øBi-t/2=øBo;$$

$$øAi+øBi=øAo+øBo=2e;$$

$$øDi=n\cdot(øAi+øBi);$$

$$øDo=(n+1)\cdot(øAo+øBo); \text{ and}$$

$$(n+1)\cdot øDi=n\cdot øDo,$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

17. An oil pump rotor assembly according to claim 10, wherein the inner rotor and the outer rotor are formed such that the following equations are satisfied:

$$øAi+t/(n+2)=øAo;$$

$$øBi=øBo;$$

$$øAi+øBi=2e;$$

$$øDi=n\cdot(øAi+øBi); \text{ and}$$

$$øDo=øDi\cdot(n+1)/n+t\cdot(n+1)/(n+2),$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

18. An oil pump rotor assembly according to claim 10, wherein the inner rotor and the outer rotor are formed such that the following equations are satisfied:

$$øAi=øAo;$$

$$øBi+t/(n+2)=øBo;$$

$$øAi+øBi=2e;$$

$$øDi=n\cdot(øAi+øBi); \text{ and}$$

$$øDo=øDi\cdot(n+1)/n+t\cdot(n+\mathbf{1})/(n+2),$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

19. An oil pump rotor assembly comprising:

an inner rotor having "n" external teeth ("n" is a natural number); an outer rotor having (n+1) internal teeth which are engageable with the external teeth; and the distance between an apex of an outer tooth of the inner rotor and an apex of an inner tooth of the outer rotor when the apexes oppose each other defining a tip clearance therebetween, wherein the oil pump rotor assembly is used in an oil pump which further includes a casing having a suction port for drawing fluid and a discharge port for discharging fluid, and which conveys fluid by drawing and discharging fluid by volume change of cells formed between tooth profiles of the inner rotor and the outer rotor during relative rotation between the inner rotor and the outer rotor engaging each other, wherein the tooth tip profile of the inner rotor is formed such that an epicycloid curve, which is generated by rolling a circumscribed-rolling circle Ai along a base circle Di without slip, is equally divided into two at a midpoint thereof to obtain two outer tooth curve segments, and the two outer tooth curve segments are separated by a predetermined distance and are smoothly connected to each other using a curve or a straight line, wherein the tooth space profile of the inner rotor is formed based on a hypocycloid curve which is formed by rolling an inscribed-rolling circle Bi along the base circle Di without slip, wherein the tooth space profile of the outer rotor is formed based on an epicycloid curve which is formed by rolling a circumscribed-rolling circle Ao along a base circle Do without slip, wherein the tooth tip profile of the outer rotor is formed such that a hypocycloid curve, which is generated by rolling an inscribed-rolling circle Bo along the base circle Do without slip, is equally divided into two at a midpoint thereof to obtain two inner tooth curve segments, and the inner tooth curve segments are separated by a predetermined distance and are smoothly connected to each other using a curve or a straight line, and wherein the predetermined distance between the two outer tooth curve segments is designated by "α", the predetermined distance between the two inner tooth curve segments is designated by "β", and the tip clearance is designated by "t", "α" and "β" are set so as to satisfy the following inequalities:

$$t/4 \leqq \alpha \leqq 3t/4; \text{ and}$$

$$t/4 \leqq \beta \leqq 3t/4.$$

20. An oil pump rotor assembly according to claim 19, wherein the separation of the two outer tooth curve segments is performed in such a manner that the two outer tooth curve segments are moved along the circumference of the base circle Di, and the separation of the two inner tooth curve segments is performed in such a manner that the two inner tooth curve segments are moved along the circumference of the base circle Do.

21. An oil pump rotor assembly according to claim 19, wherein the separation of the two outer tooth curve segments is performed in such a manner that the two outer tooth curve segments are moved in the direction of a tangent of the epicycloid curve drawn at the midpoint thereof, the separation of the two inner tooth curve segments is performed in such a manner that the two inner tooth curve segments are moved in the direction of a tangent of the hypocycloid curve drawn at the midpoint thereof.

22. An oil pump rotor assembly according to claim 19, wherein the separation of the two outer tooth curve segments is performed in such a manner that the two outer tooth curve segments are first moved along the circumference of the base circle Di, and then moved in the direction of a tangent of the epicycloid curve drawn at the midpoint thereof, and the separation of the two inner tooth curve segments is performed in such a manner that the two inner tooth curve segments are first moved along the circumference of the base circle Do, and then moved in the direction of a tangent of the hypocycloid curve drawn at the midpoint thereof.

23. An oil pump rotor assembly according to claim 19, wherein the separation of the two outer tooth curve segments is performed in such a manner that the two outer tooth curve segments are first moved in the direction of a tangent of the epicycloid curve drawn at the midpoint thereof, and then moved along the circumference of the base circle Di, and the separation of the two inner tooth curve segments is performed in such a manner that the two inner tooth curve segments are first moved in the direction of a tangent of the hypocycloid curve drawn at the midpoint thereof, and then moved along the circumference of the base circle Do.

24. An oil pump rotor assembly according to claim 15, wherein the predetermined distance "α" and the predetermined distance "β" are set so as to satisfy the following inequalities:

$$2t/5 \leqq \alpha \leqq 3t/5;$$

and $$2t/5 \leqq \beta \leqq 3t/5.$$

25. An oil pump rotor assembly according to claim 19, wherein the inner rotor and the outer rotor are formed such that the following equations are satisfied:

$$øAi+t/2=øAo;$$

$$øBi-t/2=øBo;$$

$$øAi+øBi=øAo+øBo=2e;$$

$$øDi=n\cdot(øAi+øBi);$$

$$øDo=(n+1)\cdot(øAo+øBo); \text{ and}$$

$$(n+1)\cdot øDi=n\cdot øDo,$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

26. An oil pump rotor assembly according to claim 19, wherein the inner rotor and the outer rotor are formed such that the following equations are satisfied:

$$øAi+t/(n+2)=øAo;$$

$$øBi=øBo;$$

$$øAi+øBi=2e;$$

$$øDi=n\cdot(øAi+øBi); \text{ and}$$

$$øDo=øDi\cdot(n+1)/n+t\cdot(n+1)/(n+2),$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

27. An oil pump rotor assembly according to claim 19, wherein the inner rotor and the outer rotor are formed such that the following equations are satisfied:

$$øAi=øAo;$$

$$øBi+t/(n+2)=øBo;$$

$$øAi+øBi=2e;$$

$$øDi=n\cdot(øAi+øBi);\text{ and}$$

$$øDo=øDi\cdot(n+1)/n+t\cdot(n+1)/(n+2),$$

where, øDi is the diameter of the base circle Di of the inner rotor, øAi is the diameter of the circumscribed-rolling circle Ai, øBi is the diameter of the inscribed-rolling circle Bi, øDo is the diameter of the base circle Do of the outer rotor, øAo is the diameter of the circumscribed-rolling circle Ao, øBo is the diameter of the inscribed-rolling circle Bo, "e" is an eccentric distance between the inner rotor and the outer rotor, and "t" is a tip clearance.

* * * * *

UNITED STATES PATENT AND TRADEMARK OFFICE

CERTIFICATE OF CORRECTION

PATENT NO. : 7,118,359 B2
APPLICATION NO. : 10/622107
DATED : October 10, 2006
INVENTOR(S) : Katsuaki Hosono It is certified that error appears in the above-identified patent and that said Letters Patent is hereby corrected as shown below:

In Column 33, lines 58 approximately, in claim 6, after "distance" delete "60" and insert --α--

In Column 35, lines 58 approximately, in claim 15, after "claim" delete "8," and insert --10,--

In Column 35, lines 63 approximately, in claim 16, after "claim" delete "8," and insert --10,--

In Column 38, lines 17 approximately, in claim 24, after "claim" delete "15" and insert --19--

Signed and Sealed this

Twenty-second Day of July, 2008

JON W. DUDAS
*Director of the United States Patent and Trademark Office*